US006682169B2

(12) United States Patent
Otsuki

(10) Patent No.: US 6,682,169 B2
(45) Date of Patent: Jan. 27, 2004

(54) PRINTING BY SWITCHING SUB-SCAN FEEDING BETWEEN MONOCHROMATIC AREA AND COLOR AREA

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 32 days.

(21) Appl. No.: 10/125,581

(22) Filed: Apr. 19, 2002

(65) Prior Publication Data

US 2002/0163550 A1 Nov. 7, 2002

(30) Foreign Application Priority Data

Apr. 20, 2001 (JP) ..... 2001-122178

(51) Int. Cl.[7] ..... B41J 2/15; B41J 2/145
(52) U.S. Cl. ..... 347/41
(58) Field of Search ..... 347/16, 43, 41, 347/12

(56) References Cited

U.S. PATENT DOCUMENTS 5,600,353 A 2/1997 Hickman et al.
6,086,181 A * 7/2000 Majette et al. ..... 347/16

FOREIGN PATENT DOCUMENTS

EP 558236 A2 * 9/1993 ..... 347/43
EP 0 730 969 A 9/1996
EP 1 065 063 A 1/2001
JP 8-238805 9/1996
JP 8-244256 9/1996
JP 10-337892 12/1998
JP 2001-047617 2/2001

* cited by examiner

*Primary Examiner*—Thinh Nguyen

(57) ABSTRACT

Efficient printing of data including two types of areas in the sub-scan direction, color areas and monochromatic areas, is present. In monochromatic mode printing, when specific situation has come, the process shifts to color mode printing, after a designated positioning feed Sm1 is performed and a unit scan operation is performed while forming dots on main scan lines Lr1 of the monochromatic area. The situation is defined as follows, (A) when the main scan lines of the lower edge of the main scan lines recorded in a unit scan operation are in a color area, when a monochromatic mode sub-scan Sm is performed next, and (B) when the main scan lines of the lower edge of the achromatic unit band are not in a color area, when in place of the monochromatic mode sub-scan Sm, a color mode sub-scan Sc (Sc<Sm) is performed. The positioning feed is a feed that performs a sub-scan so that the position separated downward by the width L1 of the achromatic unit band from the upper edge nozzle is in a relative position that matches the main scan line of the lower edge of the monochromatic area.

27 Claims, 24 Drawing Sheets

*Fig.4*

| MAIN SCAN LINE COUNT | | | PASS COUNT 1 | 2 | 3 | 4 |
|---|---|---|---|---|---|---|
| 1 | K | (Y) | #1 | | | |
| 2 | | | | #1 | | |
| 3 | | | | | #1 | |
| 4 | | | | | | #1 |
| 5 | K | (Y) | #2 | | | |
| 6 | | | | #2 | | |
| 7 | | | | | #2 | |
| 8 | | | | | | #2 |
| 9 | K | (M) | #3 | | | |
| 10 | | | | #3 | | |
| 11 | | | | | #3 | |
| 12 | | | | | | #3 |
| 13 | K | (M) | #4 | | | |
| 14 | | | | #4 | | |
| 15 | | | | | #4 | |
| 16 | | | | | | #4 |
| 17 | K0 | (C) | #5 | | | |
| 18 | | | | #5 | | |
| 19 | | | | | #5 | |
| 20 | | | | | | #5 |
| 21 | K0 | (C) | #6 | | | |
| 22 | | | | #6 | | |
| 23 | | | | | #6 | |
| 24 | | | | | | #6 |

L1

*Fig.5*

| MAIN SCAN LINE COUNT | | | PASS COUNT 1 | 2 | 3 | 4 | |
|---|---|---|---|---|---|---|---|
| 1 | (K) | Y | #1 | | | | |
| 2 | | | | #1 | | | |
| 3 | | | | | #1 | | |
| 4 | | | | | | #1 | |
| 5 | (K) | Y | #2 | | | | L2(Y) |
| 6 | | | | #2 | | | |
| 7 | | | | | #2 | | |
| 8 | | | | | | #2 | |
| 9 | (K) | M | #1 | | | | |
| 10 | | | | #1 | | | |
| 11 | | | | | #1 | | |
| 12 | | | | | | #1 | |
| 13 | (K) | M | #2 | | | | L2(M) |
| 14 | | | | #2 | | | |
| 15 | | | | | #2 | | |
| 16 | | | | | | #2 | |
| 17 | K0 | C | #1 | | | | |
| 18 | | | | #1 | | | |
| 19 | | | | | #1 | | |
| 20 | | | | | | #1 | |
| 21 | K0 | C | #2 | | | | L2(C,K) |
| 22 | | | | #2 | | | |
| 23 | | | | | #2 | | |
| 24 | | | | | | #2 | |

Fig.15

| MAIN SCAN LINE COUNT | | | PASS COUNT 1 | 2 | 3 | 4 |
|---|---|---|---|---|---|---|
| 1 | K | (Y) | #1 | | | |
| 2 | | | | | | |
| 3 | | | | | | |
| 4 | | | | #1 | | |
| 5 | K | (Y) | #2 | | | |
| 6 | | | | | | |
| 7 | | | | | #1 | |
| 8 | | | | #2 | | |
| 9 | K | (Y) | #3 | | | |
| 10 | | | | | | #1 |
| 11 | | | | | #2 | |
| 12 | | | | #3 | | |
| 13 | K | (Y) | #4 | | | |
| 14 | | | | | | #2 |
| 15 | | | | | #3 | |
| 16 | | | | #4 | | |
| 17 | K | (Y) | #5 | | | |
| 18 | | | | | | #3 |
| 19 | | | | | #4 | |
| 20 | | | | #5 | | |
| 21 | K | (M) | #6 | | | |
| 22 | | | | | | #4 |
| 23 | | | | | #5 | |
| 24 | | | | #6 | | |
| 25 | K | (M) | #7 | | | |
| 26 | | | | | | #5 |
| 27 | | | | | #6 | |
| 28 | | | | #7 | | |
| 29 | K | (M) | #8 | | | |
| 30 | | | | | | #6 |
| 31 | | | | | #7 | |
| 32 | | | | #8 | | |
| 33 | K | (M) | #9 | | | |
| 34 | | | | | | #7 |
| 35 | | | | | #8 | |
| 36 | | | | #9 | | |
| 37 | K | (M) | #10 | | | |
| 38 | | | | | | #8 |
| 39 | | | | | #9 | |
| 40 | | | | #10 | | |
| 41 | K0 | (C) | #11 | | | |
| 42 | | | | | | #9 |
| 43 | | | | | #10 | |
| 44 | | | | #11 | | |
| 45 | K0 | (C) | #12 | | | |
| 46 | | | | | | #10 |
| 47 | | | | | #11 | |
| 48 | | | | #12 | | |
| 49 | K0 | (C) | #13 | | | |
| 50 | | | | | | #11 |
| 51 | | | | | #12 | |
| 52 | | | | #13 | | |
| 53 | K0 | (C) | #14 | | | |
| 54 | | | | | | #12 |
| 55 | | | | | #13 | |
| 56 | | | | #14 | | |
| 57 | K0 | (C) | #15 | | | |
| 58 | | | | | | #13 |
| 59 | | | | | #14 | |
| 60 | | | | #15 | | |
| 61 | | | | | | |
| 62 | | | | | | #14 |
| 63 | | | | | #15 | |
| 64 | | | | | | |
| 65 | | | | | | |
| 66 | | | | | | #15 |
| 67 | | | | | | |

L1

Fig. 16

| MAIN SCAN LINE COUNT | | | PASS COUNT 1 | 2 | 3 | 4 | |
|---|---|---|---|---|---|---|---|
| 1 | (K) | Y | #1 | | | | |
| 2 | | | | | | | |
| 3 | | | | | | | |
| 4 | | | | #1 | | | |
| 5 | (K) | Y | #2 | | | | |
| 6 | | | | | | | |
| 7 | | | | | #1 | | |
| 8 | | | | #2 | | | |
| 9 | (K) | Y | #3 | | | | |
| 10 | | | | | | #1 | |
| 11 | | | | | #2 | | L2(Y) |
| 12 | | | | #3 | | | |
| 13 | (K) | Y | #4 | | | | |
| 14 | | | | | | #2 | |
| 15 | | | | | #3 | | |
| 16 | | | | #4 | | | |
| 17 | (K) | Y | #5 | | | | |
| 18 | | | | | | #3 | |
| 19 | | | | | #4 | | |
| 20 | | | | #5 | | | |
| 21 | (K) | M | #1 | | | | |
| 22 | | | | | | #4 | |
| 23 | | | | | #5 | | |
| 24 | | | | #1 | | | |
| 25 | (K) | M | #2 | | | | |
| 26 | | | | | | #5 | |
| 27 | | | | | #1 | | |
| 28 | | | | #2 | | | |
| 29 | (K) | M | #3 | | | | |
| 30 | | | | | | #1 | |
| 31 | | | | | #2 | | L2(M) |
| 32 | | | | #3 | | | |
| 33 | (K) | M | #4 | | | | |
| 34 | | | | | | #2 | |
| 35 | | | | | #3 | | |
| 36 | | | | #4 | | | |
| 37 | (K) | M | #5 | | | | |
| 38 | | | | | | #3 | |
| 39 | | | | | #4 | | |
| 40 | | | | #5 | | | |
| 41 | K0 | C | #1 | | | | |
| 42 | | | | | | #4 | |
| 43 | | | | | #5 | | |
| 44 | | | | #1 | | | |
| 45 | K0 | C | #2 | | | | |
| 46 | | | | | | #5 | |
| 47 | | | | | #1 | | |
| 48 | | | | #2 | | | |
| 49 | K0 | C | #3 | | | | |
| 50 | | | | | | #1 | |
| 51 | | | | | #2 | | |
| 52 | | | | #3 | | | L2(C, K) |
| 53 | K0 | C | #4 | | | | |
| 54 | | | | | | #2 | |
| 55 | | | | | #3 | | |
| 56 | | | | #4 | | | |
| 57 | K0 | C | #5 | | | | |
| 58 | | | | | | #3 | |
| 59 | | | | | #4 | | |
| 60 | | | | #5 | | | |
| 61 | | | | | | | |
| 62 | | | | | | #4 | |
| 63 | | | | | #5 | | |
| 64 | | | | | | | |
| 65 | | | | | | | |
| 66 | | | | | | #5 | |
| 67 | | | | | | | |

Fig.21

| MAIN SCAN LINE COUNT | | | PASS COUNT 1 | 2 | 3 | 4 |
|---|---|---|---|---|---|---|
| 1 | K | (Y) | #1 | | | |
| 2 | | | | #1 | | |
| 3 | | | | | #1 | |
| 4 | | | | | | #1 |
| 5 | K | (Y) | #2 | | | |
| 6 | | | | #2 | | |
| 7 | | | | | #2 | |
| 8 | | | | | | #2 |
| 9 | K | (Y) | #3 | | | |
| 10 | | | | #3 | | |
| 11 | | | | | #3 | |
| 12 | | | | | | #3 |
| 13 | K | (Y) | #4 | | | |
| 14 | | | | #4 | | |
| 15 | | | | | #4 | |
| 16 | | | | | | #4 |
| 17 | K | (Y) | #5 | | | |
| 18 | | | | #5 | | |
| 19 | | | | | #5 | |
| 20 | | | | | | #5 |
| 21 | K | (M) | #6 | | | |
| 22 | | | | #6 | | |
| 23 | | | | | #6 | |
| 24 | | | | | | #6 |
| 25 | K | (M) | #7 | | | |
| 26 | | | | #7 | | |
| 27 | | | | | #7 | |
| 28 | | | | | | #7 |
| 29 | K | (M) | #8 | | | |
| 30 | | | | #8 | | |
| 31 | | | | | #8 | |
| 32 | | | | | | #8 |
| 33 | K | (M) | #9 | | | |
| 34 | | | | #9 | | |
| 35 | | | | | #9 | |
| 36 | | | | | | #9 |
| 37 | K | (M) | #10 | | | |
| 38 | | | | #10 | | |
| 39 | | | | | #10 | |
| 40 | | | | | | #10 |
| 41 | K0 | (C) | #11 | | | |
| 42 | | | | #11 | | |
| 43 | | | | | #11 | |
| 44 | | | | | | #11 |
| 45 | K0 | (C) | #12 | | | |
| 46 | | | | #12 | | |
| 47 | | | | | #12 | |
| 48 | | | | | | #12 |
| 49 | K0 | (C) | #13 | | | |
| 50 | | | | #13 | | |
| 51 | | | | | #13 | |
| 52 | | | | | | #13 |
| 53 | K0 | (C) | #14 | | | |
| 54 | | | | #14 | | |
| 55 | | | | | #14 | |
| 56 | | | | | | #14 |
| 57 | K0 | (C) | #15 | | | |
| 58 | | | | #15 | | |
| 59 | | | | | #15 | |
| 60 | | | | | | #15 |
| 61 | | | | | | |

L1

Fig.22

| MAIN SCAN LINE COUNT | | | PASS COUNT 1 | 2 | 3 | 4 | |
|---|---|---|---|---|---|---|---|
| 1 | (K) | Y | #1 | | | | |
| 2 | | | | #1 | | | |
| 3 | | | | | #1 | | |
| 4 | | | | | | #1 | |
| 5 | (K) | Y | #2 | | | | |
| 6 | | | | #2 | | | |
| 7 | | | | | #2 | | |
| 8 | | | | | | #2 | |
| 9 | (K) | Y | #3 | | | | |
| 10 | | | | #3 | | | |
| 11 | | | | | #3 | | L2(Y) |
| 12 | | | | | | #3 | |
| 13 | (K) | Y | #4 | | | | |
| 14 | | | | #4 | | | |
| 15 | | | | | #4 | | |
| 16 | | | | | | #4 | |
| 17 | (K) | Y | #5 | | | | |
| 18 | | | | #5 | | | |
| 19 | | | | | #5 | | |
| 20 | | | | | | #5 | |
| 21 | (K) | M | #1 | | | | |
| 22 | | | | #1 | | | |
| 23 | | | | | #1 | | |
| 24 | | | | | | #1 | |
| 25 | (K) | M | #2 | | | | |
| 26 | | | | #2 | | | |
| 27 | | | | | #2 | | |
| 28 | | | | | | #2 | |
| 29 | (K) | M | #3 | | | | |
| 30 | | | | #3 | | | |
| 31 | | | | | #3 | | L2(M) |
| 32 | | | | | | #3 | |
| 33 | (K) | M | #4 | | | | |
| 34 | | | | #4 | | | |
| 35 | | | | | #4 | | |
| 36 | | | | | | #4 | |
| 37 | (K) | M | #5 | | | | |
| 38 | | | | #5 | | | |
| 39 | | | | | #5 | | |
| 40 | | | | | | #5 | |
| 41 | K0 | C | #1 | | | | |
| 42 | | | | #1 | | | |
| 43 | | | | | #1 | | |
| 44 | | | | | | #1 | |
| 45 | K0 | C | #2 | | | | |
| 46 | | | | #2 | | | |
| 47 | | | | | #2 | | |
| 48 | | | | | | #2 | |
| 49 | K0 | C | #3 | | | | |
| 50 | | | | #3 | | | |
| 51 | | | | | #3 | | L2(C, K) |
| 52 | | | | | | #3 | |
| 53 | K0 | C | #4 | | | | |
| 54 | | | | #4 | | | |
| 55 | | | | | #4 | | |
| 56 | | | | | | #4 | |
| 57 | K0 | C | #5 | | | | |
| 58 | | | | #5 | | | |
| 59 | | | | | #5 | | |
| 60 | | | | | | #5 | |
| 61 | | | | | | | |

PRINTING BY SWITCHING SUB-SCAN FEEDING BETWEEN MONOCHROMATIC AREA AND COLOR AREA

BACKGROUND OF THE INVENTION

1. Field of the Invention

The present invention relates to technology for printing by forming dots on a printing medium while performing a main scan, and specifically relates to technology for printing images for which there are two types of areas, color areas and monochromatic areas, in the sub-scan direction.

2. Description of the Related Art

In recent years, as computer output devices, there has been a broad popularization of color printers of the type that eject several colors of ink from a head. Among this type of color printer, there are printers that print an image by forming dots on a printing medium by ejecting ink drops from a nozzle while performing a main scan.

Also, there are printing devices that are equipped with a higher number of nozzles that eject only black ink than those for other colored inks. For that kind of printing device, when printing color data, color printing is done using the same number of nozzles for each color. Only the same number of nozzles as the number of nozzles for each color is used for the black nozzles. Then, when printing data that is monochromatic only, the monochromatic printing is performed at high speed using all of the black nozzles.

However, with the printing device noted above, when within the printed image there are two types of areas, monochromatic areas that use only black ink, and color areas, there is the problem that printing cannot be performed efficiently.

SUMMARY OF THE INVENTION

Accordingly, an object of the present invention is to efficiently print images for which two types of areas, color areas and monochromatic areas, exist in the sub-scan direction.

To attain at least part of the above and other related objects of the present invention, there is provided a printing apparatus that prints images in a monochromatic area on a printing medium with an achromatic ink alone, and in a color area with chromatic inks, by ejecting ink drops from a nozzle to deposit the ink drops on the printing medium to form dots.

This printing apparatus comprises a printing head having a plurality of single chromatic nozzle groups and an achromatic nozzle group, a main scan drive unit that moves at least one of the printing head and the printing medium to perform main scanning, a sub-scan drive unit that moves at least one of the printing head and the printing medium in a direction that intersects a main scanning direction to perform sub-scanning, and a control unit that controls each of these units (the printing head, the main scan drive unit and the sub-scan drive unit). Each of the plurality of single chromatic nozzle groups consists of plurality of nozzles that are arranged at nozzle pitch k×D where k is an integer of at least 2 and D is a pitch of main scan lines. The plurality of single chromatic nozzle groups are configured to eject mutually different chromatic inks. The achromatic nozzle group for ejecting achromatic ink consists of a greater number of nozzles that are arranged at nozzle pitch k×D than each of the single chromatic nozzle groups.

In that apparatus, monochromatic mode printing is also executed by repeating a unit scan operation using all the nozzles of the achromatic nozzle group but without using the single chromatic nozzle groups. The unit scan operation consists of k main scans and (k−1) sub-scans of a first feed amount. The unit scan operation in the monochromatic mode printing may be performed such that all dot positions in an achromatic unit band consisting of plural main scan lines without any gap therebetween are serviced by the achromatic nozzle group. A monochromatic mode sub-scan of a second feed amount is performed in each interval between each unit scan operations.

In that apparatus, color mode printing is executed by repeating the unit scan operation using a specific achromatic nozzle group and the plurality of single chromatic nozzle groups while a color mode sub-scan of a third feed amount less than the second feed amount is performed in each interval between each unit scan operations. The specific achromatic nozzle group is part of the achromatic nozzle group.

In specific case in the monochromatic mode printing, a sub-scan of a specific feed amount is preferably performed so that the lowermost main scan line of the achromatic unit band comes to a lower edge of the monochromatic area when the unit scan operation is performed after the sub-scan of the specific feed amount. The unit scan operation is then preferably performed once, while forming dots in the monochromatic area using all nozzles of the achromatic nozzle group. The process is then proceeded to the color mode printing. The specific case is when a lowermost main scan line of the achromatic unit band comes to be positioned within the color area when it is assumed that the monochromatic mode sub-scan and the unit scan operation are performed next, and also that the lowermost main scan line of the achromatic unit band comes to be positioned within the monochromatic area when it is assumed that the color mode sub-scan and the unit scan operation are performed.

For this kind of embodiment, in above specified cases, positioning feed is performed at the end of monochromatic mode printing, and recording of the main scan lines is done using the nozzles of the achromatic nozzle group. If this kind of embodiment is used, in a case such as when the nozzles reach the color area when monochromatic mode sub-scanning is performed, monochromatic area printing can be performed more efficiently comparing to printing for which the printing process shifts directly to color mode printing.

It is preferable that each of the plurality of single chromatic nozzle groups consists of mutually equal numbers of nozzles, and the specific achromatic nozzle group includes a same number of nozzles as each of the single chromatic nozzle groups. By using such an embodiment, it is possible to print images on the printing medium efficiently.

In monochromatic mode printing, it is preferable that the printing process is proceeded to the color mode printing, in the case that the lowermost main scan line of the achromatic unit band comes to be positioned in the color area when it is assumed that the color mode sub-scan and the unit scan operation are performed. If this kind of embodiment is used, it is possible to shift from monochromatic mode printing to color mode printing efficiently.

In specific case in the monochromatic printing, a sub-scan of a specific feed amount is preferably performed so that the lowermost main scan line of the achromatic unit band comes to a lower edge of the monochromatic area when the unit scan operation is performed after the sub-scan of the specific feed amount. The unit scan operation is then preferably performed once, while forming dots in the monochromatic area using all nozzles of the achromatic nozzle group. The printing process is preferably proceeded to the color mode printing. Such procedures are performed in the specific case that main scan line count Lr1 of a remaining monochromatic area is smaller than main scan line count L1 of an achromatic unit band and is larger than main scan line count L2 of a single chromatic unit band. The remaining monochromatic area is an area of the monochromatic area in which dot formation is not completed. The single chromatic unit band consists of plural main scan lines without any gap therebetween for which a one of the single nozzle groups services with a single unit scan operation. By using such an embodiment, it is possible to shorten the time required for printing by performing positioning feed based on simple judgment criteria.

In the monochromatic printing, the printing process is preferably proceeded to the color mode printing in a case that main scan line count Lr1 of the remaining monochromatic area is smaller than the main scan line count L1 of the achromatic unit band and the main scan line count L2 of the single chromatic unit band. By using such an embodiment, it is possible to shift from monochromatic mode printing to color mode printing efficiently without performing complex processes.

In some case, it is preferable that the first feed amount is equal to D, the second feed amount is equal to N×C×k×D, and the third feed amount is equal to N×k×D. The case is as follows. The plurality of single chromatic nozzle groups includes C nozzle rows, where C is an integer of at least 2. Each nozzle row includes N nozzles, where N is an integer of at least 2, arranged in the sub-scan direction at the nozzle pitch k×D. The achromatic nozzle group includes a nozzle row consisting of N×C nozzles arranged in the sub-scan direction at the nozzle pitch k×D. By using such an embodiment, main scan lines recorded by a unit scan operation are adjacent to each other. This makes the process of shifting modes between color mode printing and monochromatic mode printing easy.

In above case, the first feed amount may be equal to m×D (where m is an integer of 2 or greater that disjoints with k). The second feed amount may be equal to a feed amount for which the sub-scan is performed at a relative position so that the nozzle of the upper edge of the achromatic nozzle group is positioned on the main scan line one below the lower edge of the bundle of main scan lines without any gap therebetween, these being the bundle of main scan lines recorded by the immediately prior unit scan operation. The third feed amount may be equal to a feed amount for which the sub-scan is performed at a relative position so that the nozzle positioned at the very top of the nozzles of the plurality of single chromatic nozzle groups is positioned on the main scan line one below the lower edge of the bundle of main scan lines without any gap therebetween, these being a bundle of main scan lines for which recording is completed by the immediately prior unit scan operation. By using such an embodiment, partial interlace printing is performed, the quality of the printing results increases.

In specific case, it is preferable that the printing process is proceeded to the monochromatic mode printing. The case is that all main scan lines of a color unit band come to be positioned within the monochromatic area when it is assumed that the color mode sub-scan and the unit scan operation are performed next. The color unit band consists of plural main scan lines without any gap therebetween for which an uppermost single nozzle group services with a single unit scan operation.

By using such an embodiment, for color mode printing, by recording both the color area main scan lines and the monochromatic areas together, it is possible to shift from color mode printing to monochromatic mode printing efficiently.

The present invention can be realized in a variety of embodiments such as those shown below.

(1) Printing method and printing control method
(2) Printing apparatus and printing control apparatus
(3) A computer program for realizing the aforementioned device or method
(4) A recording medium on which is recorded a computer program for realizing the aforementioned device or method
(5) Data signals implemented within carrier waves including a computer program for realizing the aforementioned device or method These and other objects, features, aspects, and advantages of the present invention will become more apparent from the following detailed description of the preferred embodiments with the accompanying drawings.

BRIEF DESCRIPTION OF THE DRAWINGS

FIG. 4 is an explanatory diagram that shows main scan line recording by a unit scan operation during monochromatic mode printing;

FIG. 5 is an explanatory diagram that shows recording of main scan lines by a unit scan operation during color mode printing;

FIG. 15 is an explanatory diagram that shows the arrangement of printer nozzles and the recording of main scan lines by a unit scan operation for a second working example;

FIG. 16 is an explanatory diagram that shows the arrangement of printer nozzles and the recording of main scan lines by a unit scan operation for a second working example;

FIG. 21 is an explanatory diagram that shows nozzles in another configuration and a unit scan operation;

FIG. 22 is an explanatory diagram that shows nozzles in another configuration and a unit scan operation;

DESCRIPTION OF THE PREFERRED EMBODIMENT

Next, we will explain embodiments of the present invention based on working examples in the sequence noted below.

A. First working example:
  A1. Device structure:
  A2. Printing:
B. Second working example:
C. Variation example:

A. FIRST WORKING EXAMPLE

Figure 1:
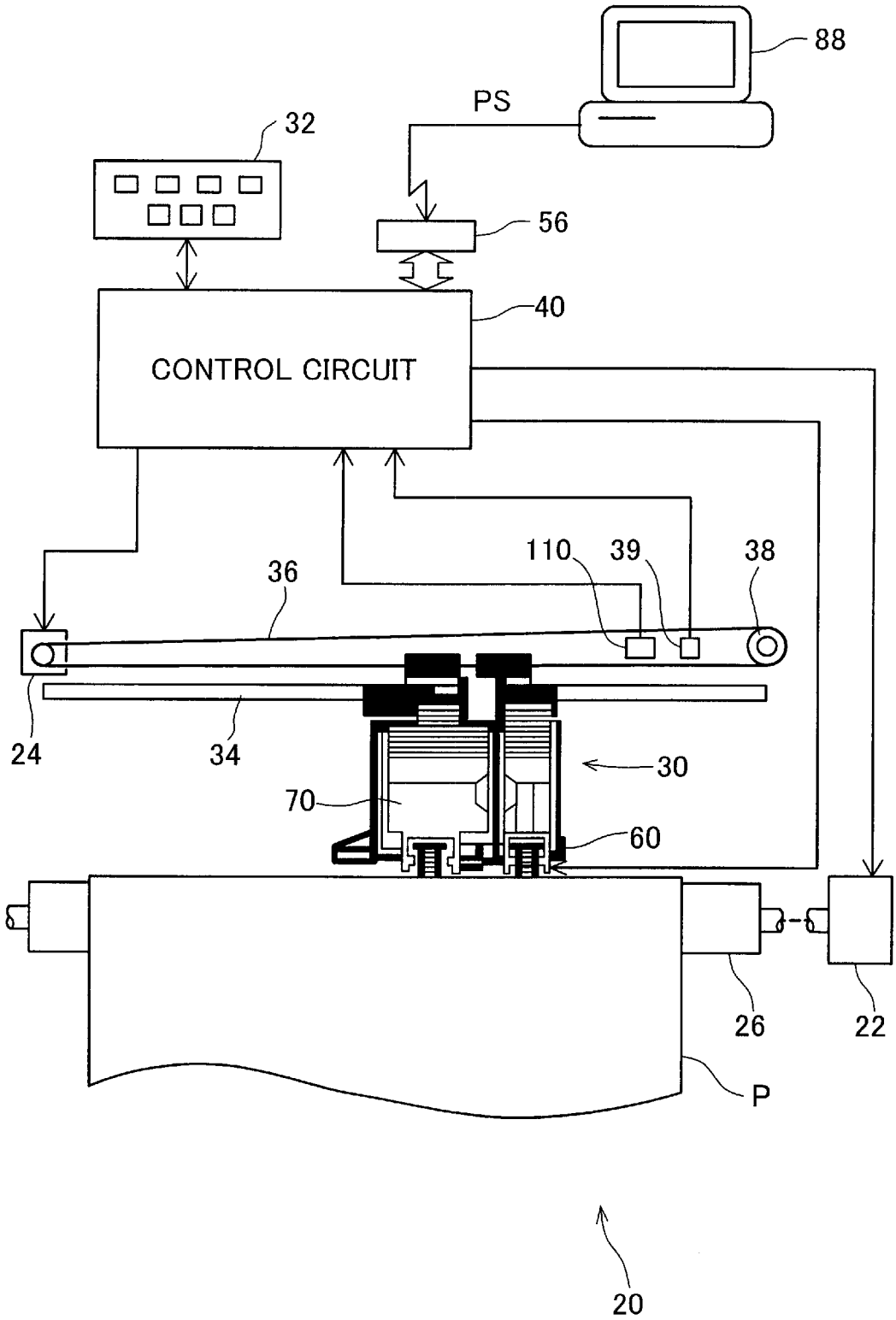
FIG. 1 is a schematic structural diagram of a printing system equipped with a printer 20 of the first working example.

A1. Device Structure:

FIG. 1 is a schematic structural diagram of a printing system equipped with an inkjet printer 20 as a working example of the present invention. This printer 20 is equipped with a main scan feeding mechanism that slides carriage 30 back and forth along sliding axis 34 using carriage motor 24, a sub-scan feeding mechanism that transports printing paper P in a direction perpendicular to the main scan direction (called "the sub-scan direction") using paper feed motor 22, a head driving mechanism that drives printing head unit 60 which is on carriage 30 and controls ink ejection and dot formation, and control circuit 40 which exchanges the control signals with these paper feed motor 22, carriage motor 24, printing head unit 60, and operating panel 32. Control circuit 40 is connected to computer 88 via connector 56.

The sub-scan feeding mechanism that transports printing paper P has a gear train (not illustrated) that conveys the rotation of paper feed motor 22 to the paper transport roller (not illustrated). Also, the main scan feed mechanism that slides carriage 30 back and forth comprises a sliding axis 34, built in a direction perpendicular to the transport direction of printing paper P, that holds carriage 30 so it is able to slide, a pulley 38 for which seamless drive belt 36 is extended between carriage 30 and carriage motor 24, and a position sensor 39 that detects the origin position of carriage 30.

Figure 2:
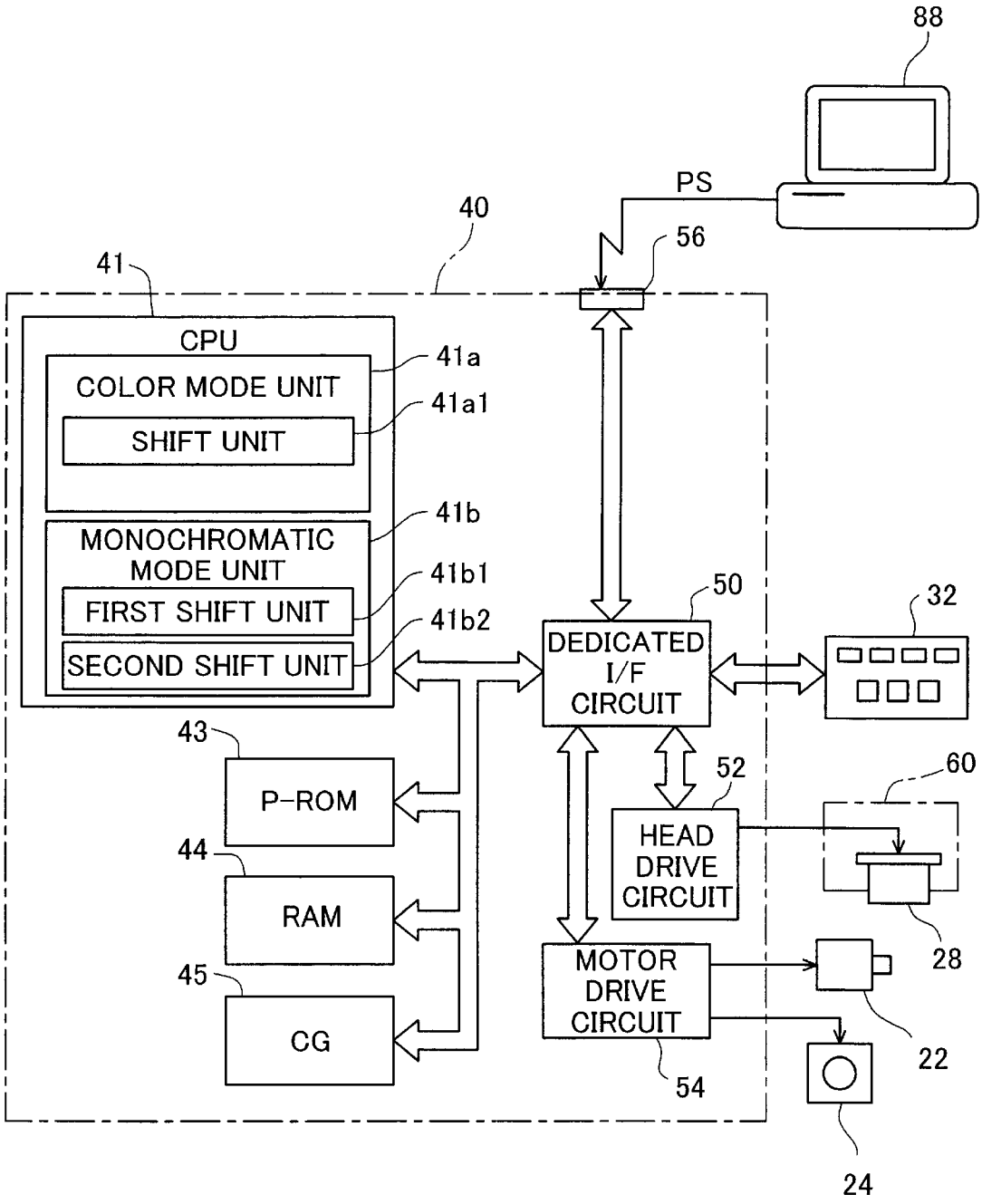
FIG. 2 is a block diagram that shows the configuration of control circuit 40 for printer 20.

FIG. 2 is a block diagram that shows the structure of a printer 20 with control circuit 40 as its core. Control circuit 40 is formed as an arithmetic logical operation circuit comprising a CPU 41, programmable ROM (PROM) 43, RAM 44, and a character generator (CG) 45 that records the dot matrix of characters. This control circuit 40 further comprises an dedicated interface circuit 50 that performs an interface exclusively with an external motor, a head drive circuit 52 that is connected to this dedicated interface circuit 50, drives the printing head unit 60, and ejects ink, and a motor drive circuit 54 that drives paper feed motor 22 and carriage motor 24. Dedicated interface circuit 50 has a built in parallel interface circuit, and can receive printing signal PS supplied from computer 88 via connector 56. By executing the computer program stored in PROM 42, CPU 41 functions as the color mode unit 41*a* and monochromatic mode unit 41*b* to be described later.

Printing head 28 has a plurality of nozzles n provided in a row for each color, and an actuator circuit 90 that operates the piezo element PE that is provided on each nozzle n. Actuator circuit 90 is part of head drive circuit 52 (see FIG. 2), and performs on/off control of drive signals given from the drive signal generating circuit (not illustrated) within head drive circuit 52. Specifically, actuator circuit 90 latches data that shows on (ink is ejected) or off (ink is not ejected) for each nozzle according to the print signal PS supplied from computer 88, and the drive signal is applied to the piezo element PE only for the nozzles that are on.

Figure 3:
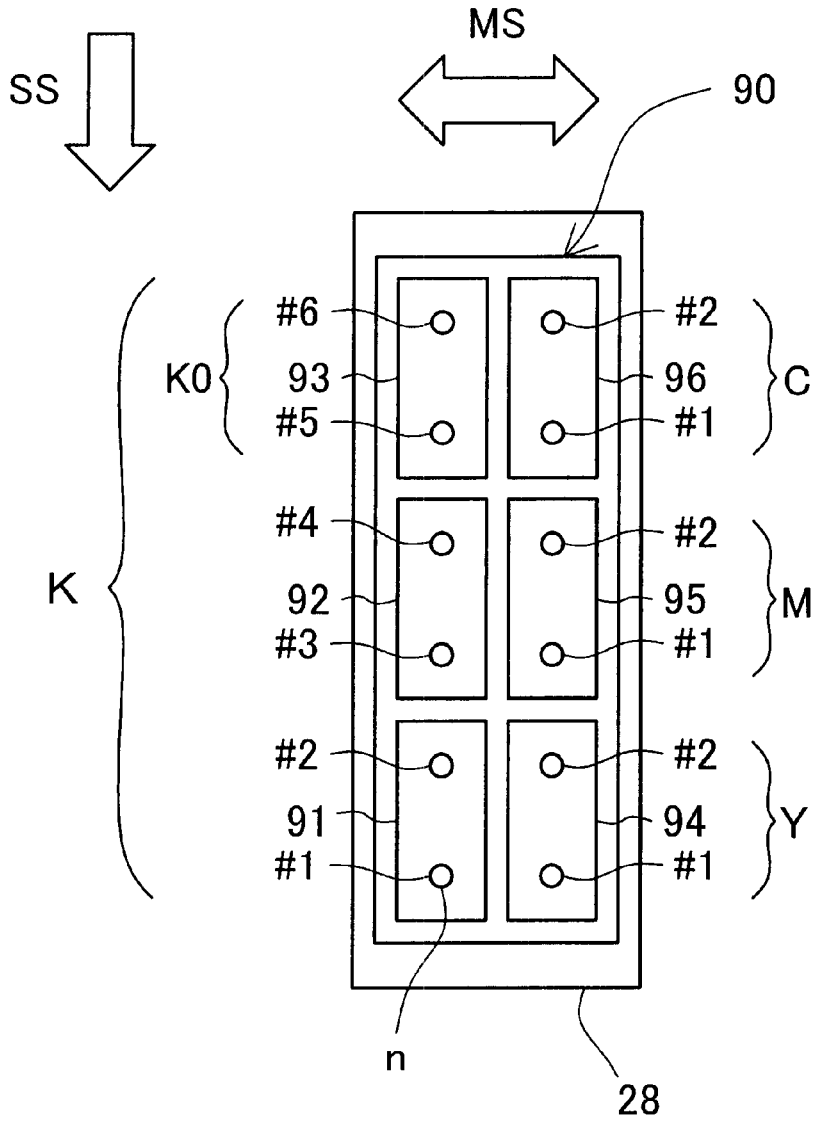
FIG. 3 is an explanatory diagram that shows the arrangement of nozzles provided in printing head 28.

FIG. 3 is an explanatory diagram that shows the arrangement of nozzles provided on printing head 28. This printer 20 is a printing apparatus that performs printing using four colors of ink, black (K), cyan (C), magenta (M), and yellow (Y), and two nozzles each are provided for cyan (C), magenta (M), and yellow (Y), while six nozzles are provided for black (K). Nozzles #1 and #2 of cyan (C), magenta (M) and yellow (Y) correlate to the "single chromatic nozzle group" noted in the claims. Nozzles #1 through #6 for black (K) correlate to the "achromatic nozzle group" noted in the claims.

Provided in actuator circuit 90 are actuator chips 91 to 93 which drive black nozzle row K, actuator chip 94 which drives cyan nozzle row C, actuator chip 95 which drives magenta nozzle row M, and actuator chip 96 which drives yellow nozzle row Y.

Printing head 28 slides back and forth along sliding axis 34 in the direction of arrow MS by carriage motor 24. Printing paper P is sent in the arrow SS direction in relation to printing head 28 by paper feed motor 22.

A2. Printing:

(1) Color Mode Printing and Monochromatic Mode Printing:

FIG. 4 is an explanatory diagram that shows recording of the main scan line by unit scan operation during monochromatic mode printing. FIG. 5 is an explanatory diagram that shows recording of the main scan line by unit scan operation during color mode printing. At the left side of each figure the typical nozzle arrangement is shown, and at the right side, the state as the main scan line is recorded by each nozzle is shown. In actuality, printing paper P is transported in relation to the printing head so that the relative position of these two items changes, but here, to make the explanation more simple, the situation is shown as the printing head moving downward in relation to printing paper P. The numbers noted in the squares marked by # show the number of the nozzle that records each main scan line. Also, in this specification, when we explain the recording of each main scan line, the front end direction when printing paper P is sent by paper feed motor 22 is called "upward" and the back end direction is called "downward."

Each row of pixels aligned in the left-right direction shows a main scan line in FIG. 4. The gap between adjacent main scan lines in the vertical direction is D. As can be seen from FIG. 4, the vertical (sub-scan direction) pitch of each nozzle on the printing head is 4×D. In this specification, the gap for adjacent main scan lines is noted as "1 dot." Therefore, the pitch for each nozzle on the printing head is 4 dots. When noting the feed amount of the sub-scan feed as well, the gap between main scan lines is noted in "dot" units as a standard. With the first working example, the nozzle pitch is 4 dots, but nozzle pitch can also be another value such as 6 or 8. Specifically, nozzle pitch k (noted in dot) should be an integer of 2 or greater.

With the printing for the first working example, a unit scan operation is performed by performing the main scan k times and fine feeds (sub-scans) of 1 dot each between each main scan. By doing this unit scan operation, dots are recorded in the band formed by a plurality of adjacent main scan lines in the sub-scan direction. Then, a large feed is performed between one unit scan operation and the next unit scan operation, so that recording is performed on the printing paper in units of main scan line bundle in sequence. With the first working example, as shown in FIGS. 4 and 5, by performing four main scan lines with three repetitions of a one dot feed, one unit scan operation is completed. Note that one main scan is called a "pass."

In FIG. 4, L1 denotes the number of the main scan lines which are recorded when a unit scan operation is performed with all the nozzles in the black nozzle group K, and lie without gaps each other. As shown in FIG. 4, L1 has 24 dots width. The agglomeration of main scan lines recorded by black ink when a unit scan operation is performed using all nozzles of the black nozzle group K are called the "achromatic unit lines," and of these, the bundle of main scan lines aligned with no gap in the sub-scan direction is called an "achromatic unit band." With the first working example, the "achromatic unit lines" is equal to "achromatic unit band". For the monochromatic mode printing which performs the unit scan operation using all the nozzles of the black nozzle group K, when one unit scan operation ends, a sub-scan of 21 main scan lines is performed to do the next unit scan operation. This sub-scan is called the "monochromatic mode sub-scan." The feed amount Sm of the monochromatic mode sub-scan is 21 dots.

The phrase, "using (all) nozzles" means that it is possible to use those nozzles during printing of that mode. Therefore, depending on the contents of the printing data sent, there are in fact cases when that nozzle is not used. Also, when a nozzle that ejects the same color ink passes over a main scan line for which recording of a colored ink has already been performed due to the situation of the sub-scan, there are cases when that nozzle is in fact not used. Note that the printing data includes not only image data but also data such as the estimated pixel pitch data and sub-scan feed amount data. When the word "image" is used in the explanation of the present invention, in addition to pictures, this includes any embodiment subject to recording on the printing medium such as text, symbols, and line drawings.

Meanwhile, for color mode printing, printing is performed using the same number of nozzles for each ink color. Because of this, only two nozzles #5 and #6 are used for the nozzles of black nozzle group K. The black nozzles used for color mode printing are called "special black nozzle group K0."

In FIG. 5, L2 denotes the number of the main scan lines which are recorded by each of single chromatic nozzle groups Y, M, and C and special black nozzle group K0 when a unit scan operation is performed with single chromatic nozzle groups Y, M, and C and special black nozzle group K0, and lie without gaps each other. The bundle of these main scan lines is called "single chromatic unit band". As shown in FIG. 5, L2 has 8 dots width. Although not shown directly in FIG. 5, the same is true for special black nozzle group K0. Therefore, for color mode printing, after one unit scan line operation ends, before the next unit scan operation is performed, sub-scan is performed for 5 main scan lines. This sub-scan is called the "color mode sub-scan." The color mode sub-scan feed amount Sc is 5 dots.

When we explain with a focus on lines 17 to 24 of FIG. 5, first, with the first unit scan operation, dots are formed at lines 17 to 24 by nozzles #5 and #6 of the special black nozzle group K0 and by cyan nozzle group C. After that, when a color mode sub-scan of 8 main scan lines is performed, magenta dots are recorded by magenta nozzle group M at lines 17 to 24. Then, when the color mode sub-scan is performed for 8 main scan lines, yellow dots are recorded on lines 17 to 24 by yellow nozzle group Y. In this way, black, cyan, magenta, and yellow color dots are formed on lines 17 to 24, thus recording a color image. Recording is performed in sequence by three unit scan operations in the same manner for each main scan line on the printing paper.

In FIG. 5, to make the explanation simpler, there is no display of recording of each main scan line by nozzles #5 and #6 of the special black nozzle group. Recording of each main scan line by these black nozzles #5 and #6 is performed in the same manner as recording of each main scan line by cyan nozzles #1 and #2.

Now we will consider the case when unit scan operation is performed using single chromatic nozzle groups Y, M, and C and special black nozzle group K0, and a color mode sub-scan is performed between each unit scan operation, in other words, the case of color mode printing. For color mode printing, each main scan line for which yellow nozzle group Y recording has ended in a unit scan operation is a main scan line for which printing data recording is completed for all inks KCMY. Specifically, recording of data for the new main scan line is completed every 8 lines for each unit scan operation. This kind of agglomeration of main scan lines for which it is possible to complete new recording by a plurality of single chromatic nozzle groups with a single unit scan operation is called a "color unit line." Of the color unit lines, the main scan lines that are aligned with no gap in the sub-scan direction are called the "color unit band." With the first working example, the "color unit lines" and the "color unit band" match. The width of the color unit band is equal to the width of the single chromatic unit band. Normally, the color unit band matches the single chromatic color band of the single chromatic nozzle group positioned at the highest level.

Color mode printing is executed by color mode unit 41*a*, and monochromatic mode printing is executed by monochromatic mode unit 41*b* (see FIG. 2).

Figure 6:
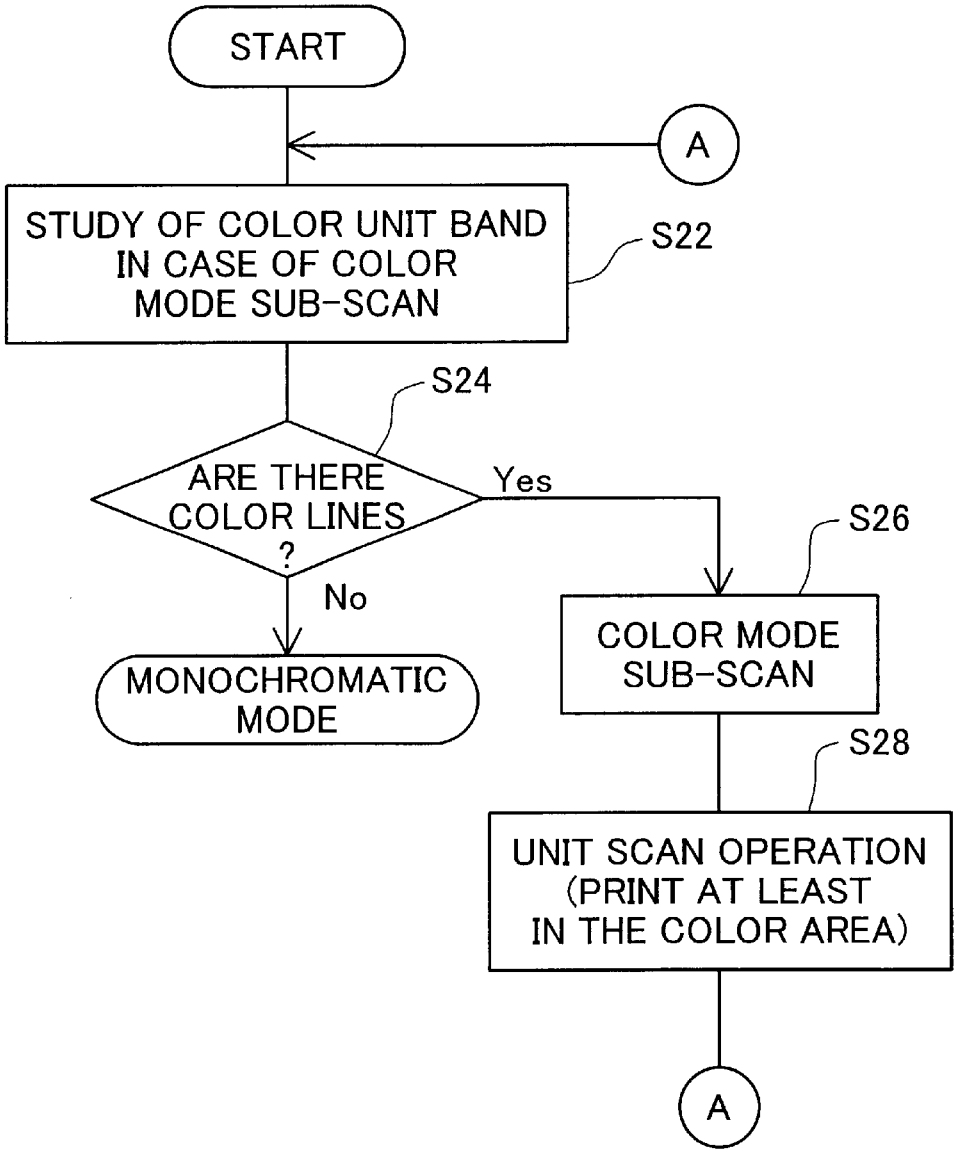
FIG. 6 is a flow chart that shows the processing for color mode printing.
Figure 7:
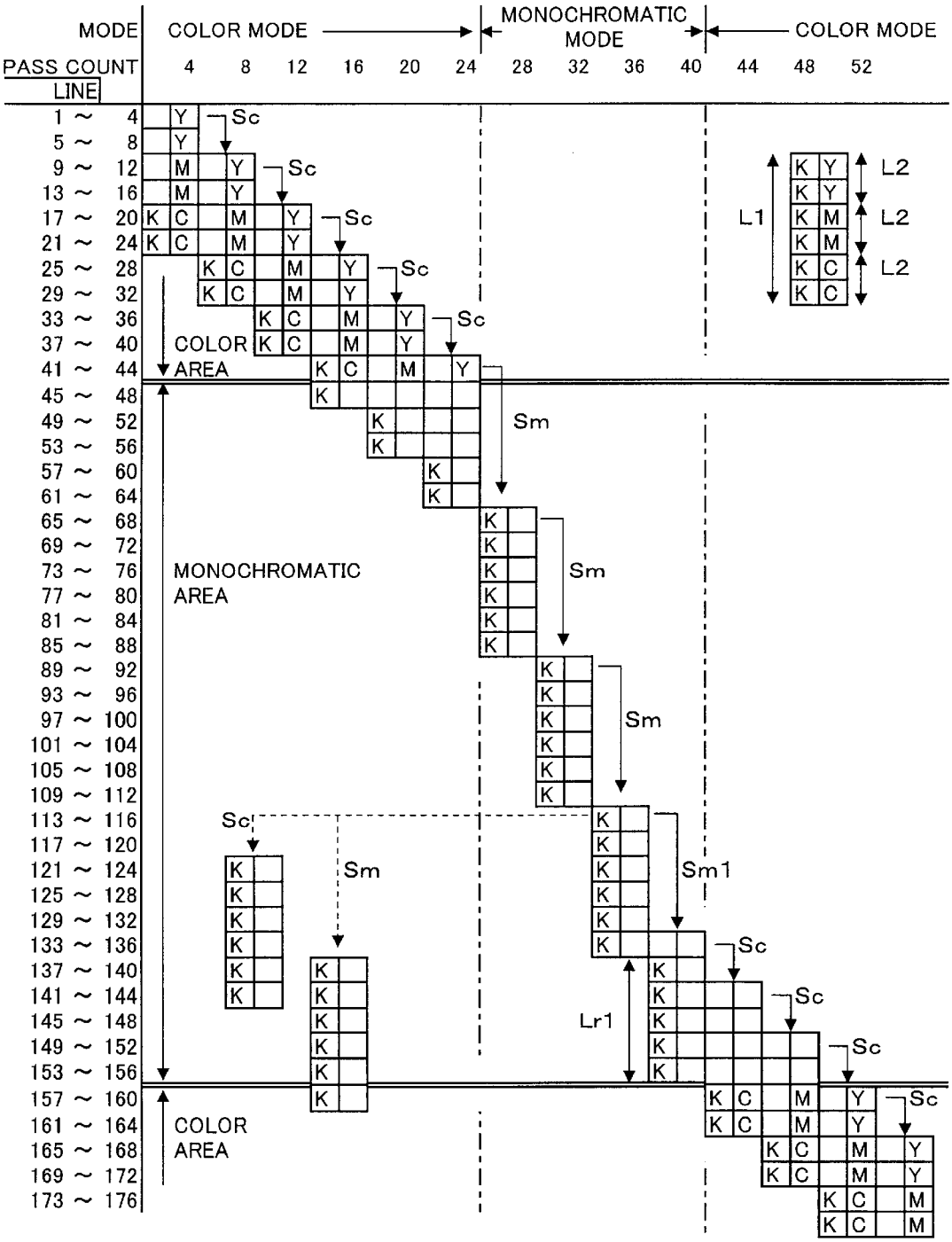
FIG. 7 is an explanatory diagram that shows how image data that contains color areas and monochromatic areas is recorded.

(2) Shift 1 From Color Mode Printing to Monochromatic Mode Printing:

FIG. 6 is a flow chart that shows the processes for color mode printing. FIG. 7 is an explanatory diagram that shows how image data including color areas and monochromatic areas is recorded. Image data to be printed includes chromatic areas and achromatic areas. As a result, there are color areas and monochromatic areas on the printing paper on which the image is to be printed that correspond respectively to the chromatic areas and achromatic areas of the image data. Color areas are areas that are recorded using at least chromatic ink. With the first working example, black ink is also used for recording the color areas. Monochromatic areas are areas for which recording is done using only achromatic ink. With the first working example, only black ink is used for recording the monochromatic areas.

In FIG. 7, main scan lines (4 lines in this case) recorded by one nozzle with a single unit scan operation are shown typically aligned in one row of squares in the horizontal direction. For example, the topmost row shows lines 1 to 4 recorded by yellow nozzle #1 with the first unit scan operation. Then, in the example in FIG. 7, lines 45 to 156 are a monochromatic area, and lines above line 44 and lines below line 157 are color areas. Also, in FIG. 7, as shown in the upper right of the figure, the printing head that executes the unit scan operation is typically shown in 2 rows×6 lines of squares. One row corresponds to an actual nozzle row (see FIGS. 4 and 5), and the area that correlates to the width of 4 main scan lines recorded by one unit scan operation by each nozzle is shown by one line. The K, C, M, and Y in each square show the color of ink ejected by each nozzle. In actuality, printing paper P is transported in relation to the printing head so that the relative position of these two items changes, but here, to make the explanation more simple in FIG. 7, the printing head shown by 2 rows×6 lines of squares is shown as being moved downward in relation to printing paper P. Then, for nozzles not actually used for each main scan line, a K, C, M, or Y is not noted in the square corresponding to each nozzle.

In color mode printing, at step S22 in FIG. 6, the problem is studied what kind of main scan line would be included in the color unit band (in this case, this matches the single chromatic color band of the yellow nozzle group) when it is assumed that a color mode sub-scan is performed next. As a result, at step S24, when there are color lines (this means main scan lines that are contained in color areas, same hereafter), a color mode sub-scan is performed at step S26, and two nozzles for each color are used to perform a unit scan operation at step S28. In the example in FIG. 7, the printing up to pass 24 is executed according to this routine.

Specifically, in color mode printing, as long as main scan lines of color area are included in the color unit band when the color mode sub-scan is performed next, steps S26 and S28 are repeated to execute color mode printing. At this time, when the printing head is in a relative position that extends across both color areas and monochromatic areas, the main scan lines of the monochromatic areas are recorded using special black nozzle group K0. In the example in FIG. 7, lines 45 to 64 are recorded in this manner.

In color mode printing, when a monochromatic line is included in the unit line or unit band recorded by executing the sub-scan studied as the next item to be performed and the unit scan operation executed thereafter, it is considered that the main scan line of the lower edge of the studied unit line or unit band is positioned in a monochromatic area. When there is no monochromatic line contained in this kind of unit line or unit band, the main scan line of the lower edge of the unit line or unit band is considered to be positioned in a color area.

Meanwhile, at step S24, when it is judged that there is no color line, in other words, when the main scan lines of the color unit band when a color mode sub-scan is performed next are all positioned in monochromatic areas, the process shifts from color mode printing to monochromatic mode printing. After shifting to monochromatic mode printing, first, a monochromatic mode sub-scan is performed. With the example shown in FIG. 7, the sub-scan performed after pass 24 is the first sub-scan performed after shifting to monochromatic mode printing according to this routine. The unit scan operation that includes passes 25 to 28 is the first unit scan operation performed after shifting to monochromatic mode printing.

At the point after pass 24, the main scan lines (lines 45 to 64) of the upper part of the monochromatic area are already recorded by special black nozzle group K0 in passes 13 to 24. Meanwhile, with monochromatic mode printing, all the nozzles of the black nozzle group K are used. Accordingly, after pass 24, performing a monochromatic mode sub-scan and the next unit scan operation (passes 25 to 28), it is possible to record the main scan lines of the monochromatic area without gaps. This kind of shift from color mode printing to monochromatic mode printing is executed by shift unit 41*a*1 of color mode unit 41*a* (see FIG. 2).

Figure 8:
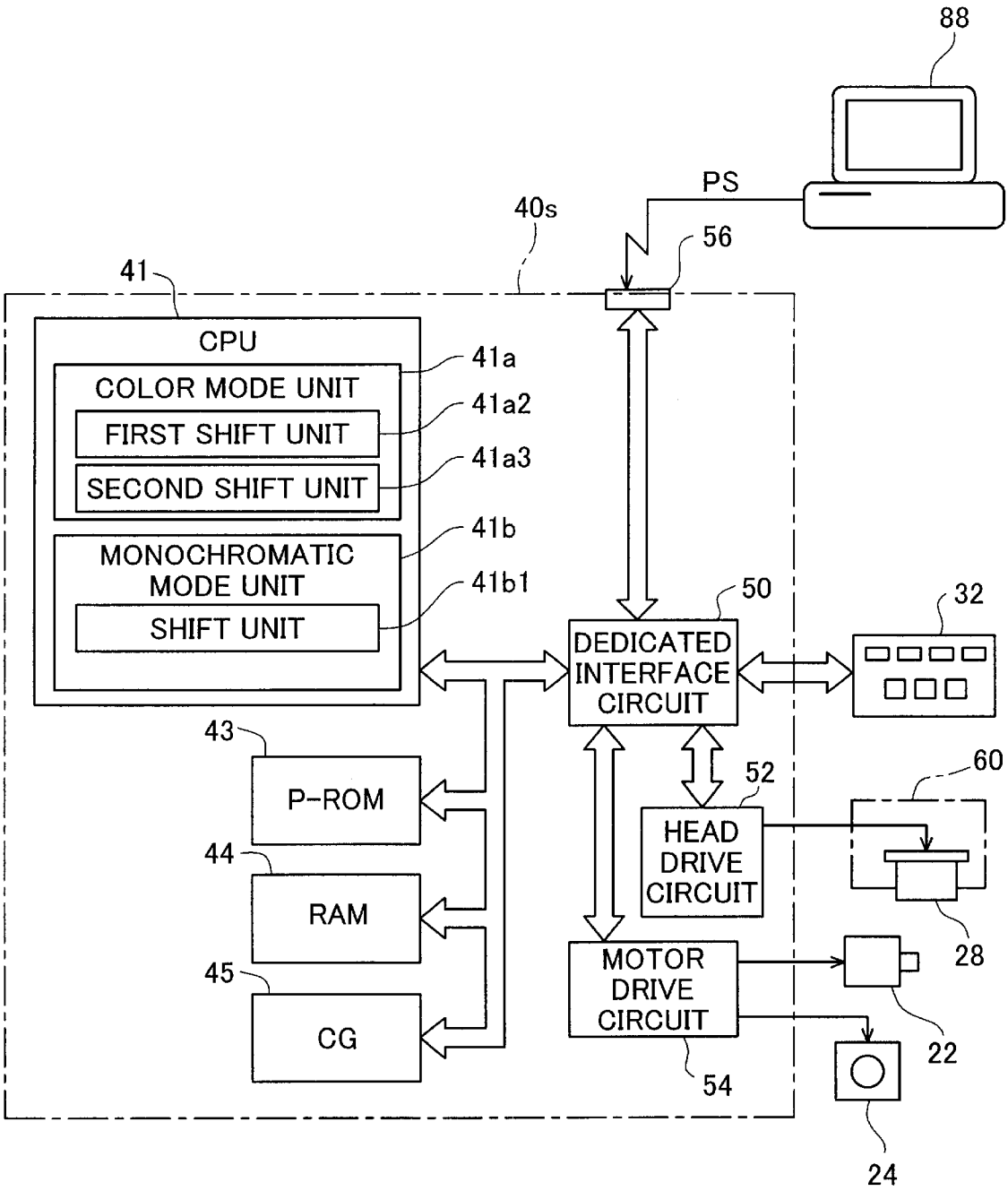
FIG. 8 is a block diagram that shows another embodiment of the control circuit of printer 20.

(3) Shift 2 From Color Mode Printing to Monochromatic Mode Printing:

FIG. 8 is a block diagram that shows another embodiment of the control circuit of printer 20. The CPU 41 of control circuit 40*s* shown in FIG. 8, similar to CPU 41 of control circuit 40 shown in FIG. 2, functions as color mode unit 41*a* and monochromatic mode unit 41*b*. However, the color mode unit 41*a* of control circuit 40*s* shown in FIG. 8 is further equipped with a first shift unit 41*a*2 and a second shift unit 41*a*3 as function units. Control circuit 40*s* shown in FIG. 8 is the same as control circuit 40 shown in FIG. 2 in other regards. For a printer having a control circuit structured in this way, it is possible to shift from color mode printing to monochromatic mode printing using a method like that noted below.

Figure 9:
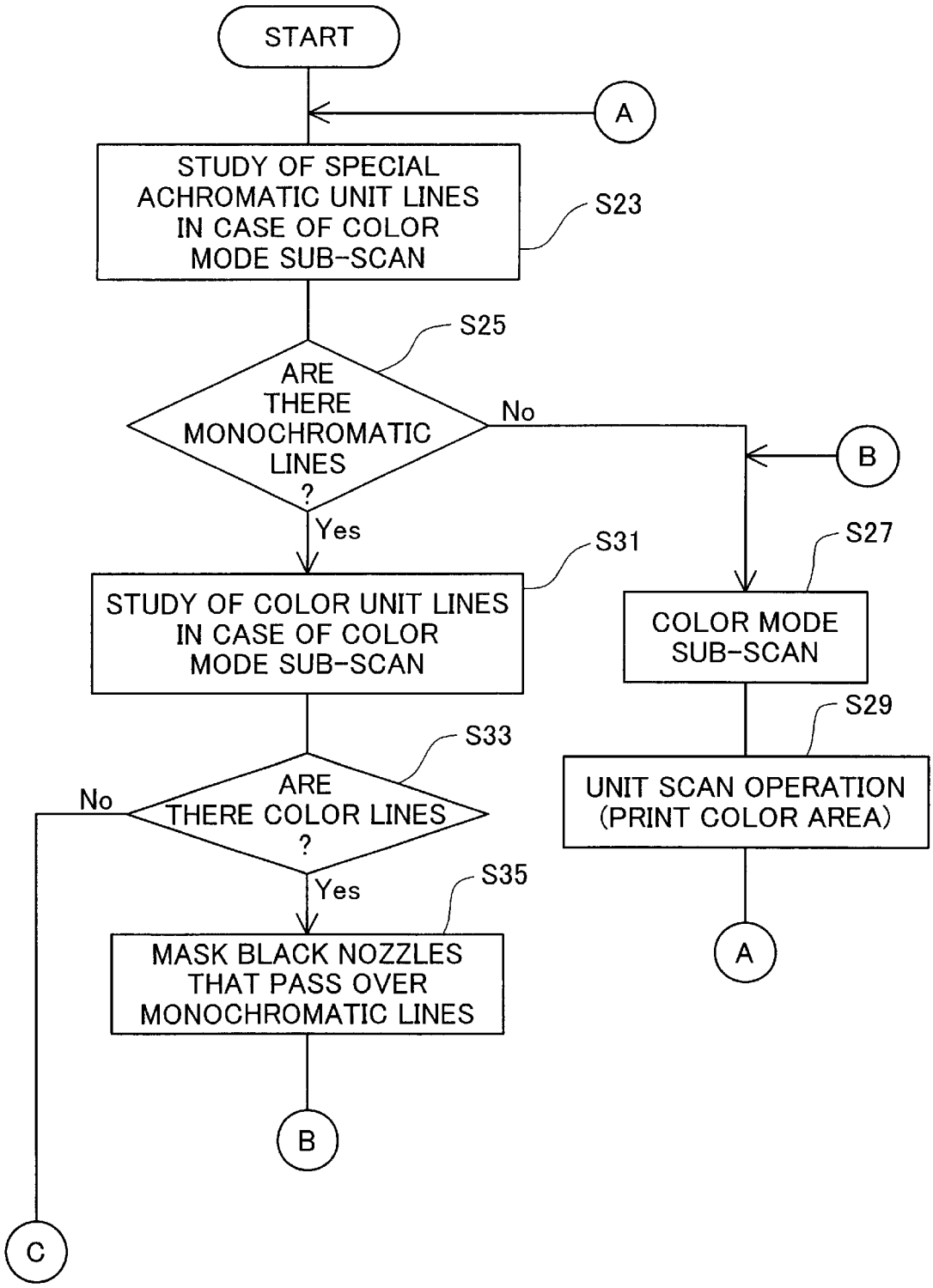
FIG. 9 is a flow chart that shows the processing of color mode printing.
Figure 10:
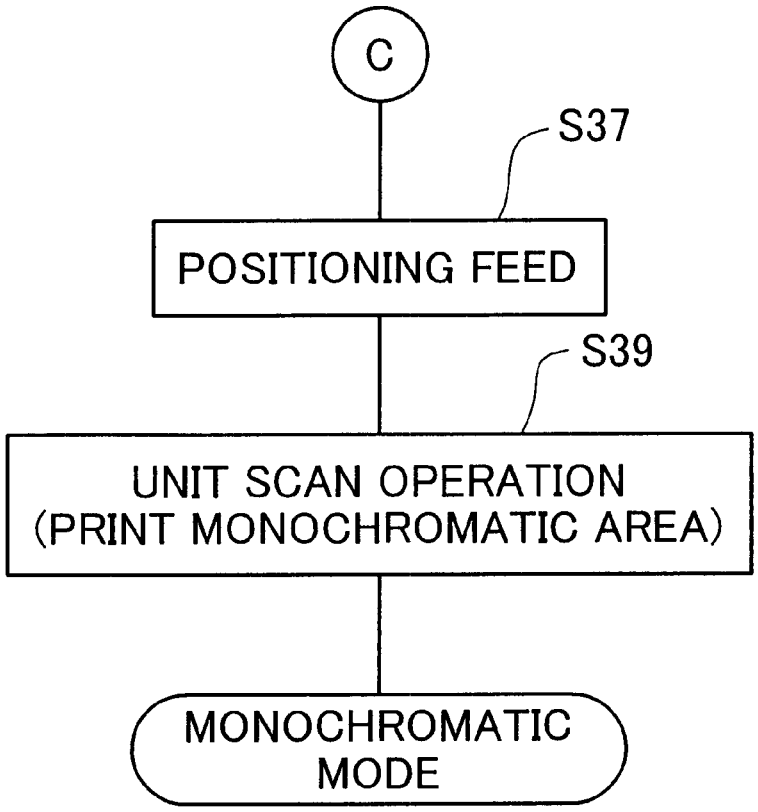
FIG. 10 is a flow chart that shows the processing of color mode printing.
Figure 11:
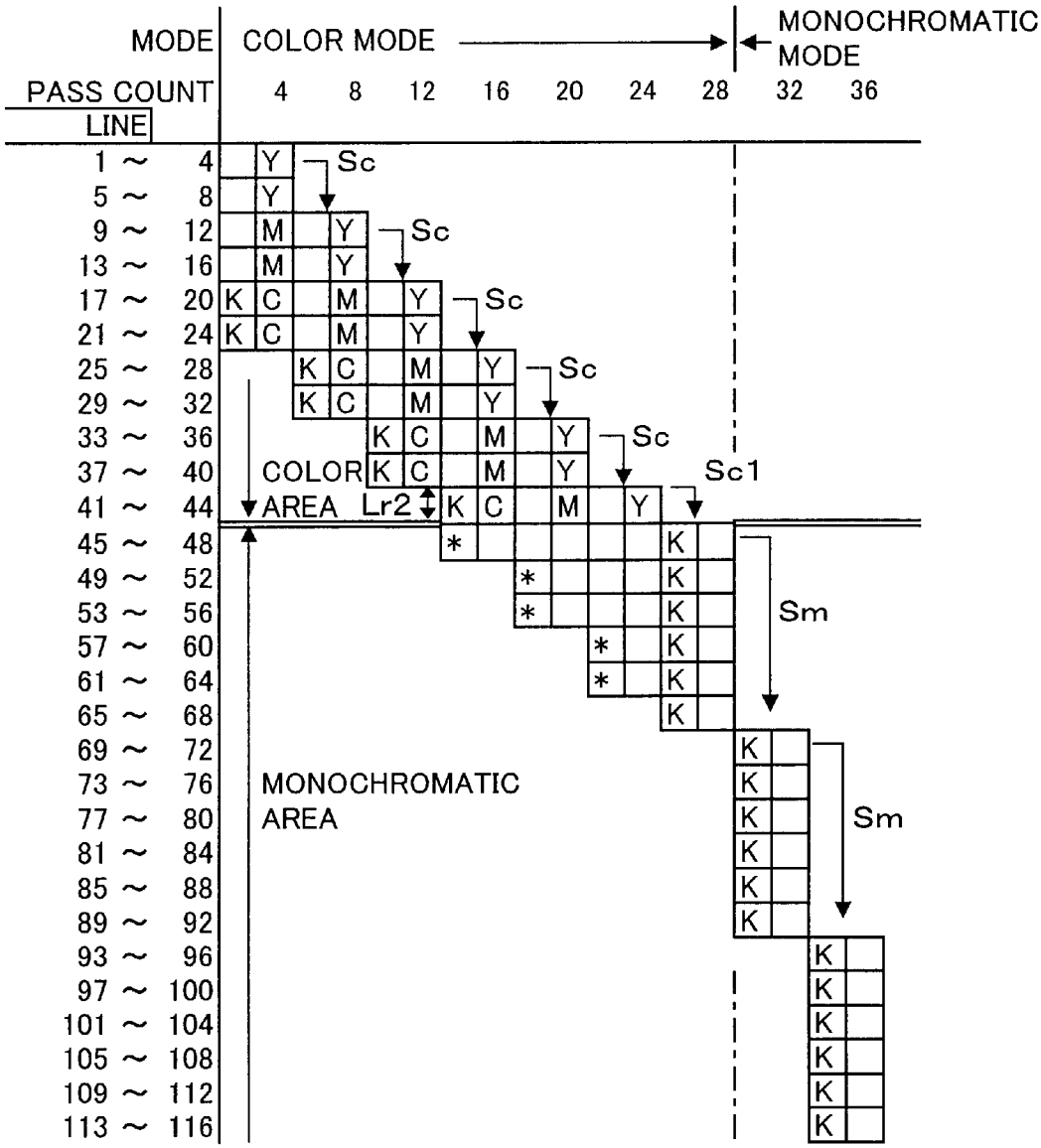
FIG. 11 is an explanatory diagram that shows how image data that contains color areas and monochromatic areas is recorded.

FIGS. 9 and 10 are flow charts that show processing for color mode printing. FIG. 11 is an explanatory diagram that shows how image data that contains color areas and monochromatic areas is recorded. For color mode printing, at step S23 in FIG. 9, a study was made of what kind of main scan line is included in the main scan lines that were recorded by special black nozzle group K0 (called "special achromatic unit lines"), when it is assumed that next the color mode sub-scan is performed and unit scan operation is performed. As a result, when there are no monochromatic lines (this means main scan lines contained in monochromatic areas; the same applies hereafter) at step S25, a color mode sub-scan is performed at step S27, and a unit scan operation is performed using two nozzles for each color at step S29. In the example shown in FIG. 11, printing up to pass 12 is executed according to this routine.

For color mode printing, when monochromatic lines are contained in the unit lines and unit bands recorded by the sub-scan studied as the next item to be performed and the unit scan operation executed thereafter, the main scan lines of the lower edge of the studied unit lines or the unit band are considered to be positioned in a monochromatic area. On the contrary, when monochromatic lines are not contained in this kind of unit line or unit band, the main scan lines of lower edge of the unit lines or the unit band are considered to be positioned in a color area.

Meanwhile, when it is determined that there are monochromatic lines at step S25, the problem is studied what kind of main scan lines are contained in the color unit lines, when it is assumed that the color mode sub-scan is performed next and a unit scan operation is performed at step S31. As a result, when it is determined that there are color lines (meaning main scan lines contained in color areas; the same holds true hereafter) at step S33, of the nozzles of special black nozzle group K0, the nozzles that pass over the monochromatic lines are masked at step S35. Then, shifting to step S27, a color mode sub-scan is performed, and at step S29, a unit scan operation is performed. In the example shown in FIG. 11, the printing from passes 13 to 24 are executed according to this routine. In the figure, nozzles which are marked by an asterisk (*) are the nozzles that are masked at step S35. The process of this kind of shift from color mode printing to monochromatic mode printing is executed by first shift unit 41*a*2 (see FIG. 8) of color mode unit 41*a*.

At step S33, when it is determined that there are no color lines in the next color unit lines, a positioning feed is performed at step S37 in FIG. 10. This positioning feed is performed so that main scan lines of the upper edge of the achromatic unit band, when it is assumed that the unit scan operation was performed using all the nozzles of the black nozzle group, are in a relative position that matches the main scan lines of the upper edge of the monochromatic area. After that, at step S39, a unit scan operation is performed using all the nozzles of the black nozzle group, and the process shifts to the monochromatic mode. In the example shown in FIG. 11, the sub-scan feed after pass 24 is the positioning feed of step S37. In the example shown in FIG. 11, the feed amount Sc1 of the positioning feed is 4 dots. Then, the unit scan operation that includes passes 25 to 28 is the unit scan operation performed at step S39. This kind of shift from color mode printing to monochromatic mode printing is executed by second shift unit 41*a*3 (see FIG. 8) of color mode unit 41*a*.

Specifically, in color mode printing, as long as main scan lines of color area are contained in the color unit lines when a color mode sub-scan is performed next, steps S27 and S29 are repeated, and color mode printing is executed. At this time, when the nozzles of special black nozzle group K0 are in a monochromatic area, those nozzles are masked (step S35), and recording of main scan lines in the monochromatic area is not performed. In the example shown in FIG. 11, at passes 13 to 24, black nozzles pass over lines 45 to 64, but those black nozzles are masked, and lines 45 to 64 are not recorded dots.

After that, if the main scan lines of the color area are not contained in the color unit lines when a color mode sub-scan is performed next (step S33 in FIG. 9), a positioning feed is performed (step S37). In the example shown in FIG. 11, the achromatic unit lines and achromatic unit bands match, so a sub-scan is performed so that the nozzle of the upper edge of black nozzle group K is positioned at line 45 which is the upper edge of the monochromatic area. After that, a unit scan operation is performed using all the nozzles of the black nozzle group K (step S39), after which monochromatic mode printing is performed.

By using this kind of embodiment, it is possible to reduce the number of color mode sub-scans, monochromatic mode sub-scans, and positioning feeds when recording the upper edge peripheral area of the monochromatic area that contacts the color area. For example, in FIG. 11, when lines 45 to 64 are recorded using the nozzles marked with an asterisk (*) at passes 13 to 24 lines, 45 to 64 of the monochromatic area are recorded by three unit scan operations between which are sandwiched two color mode sub-scans. In comparison to this, with the embodiment shown in FIG. 11, lines 45 to 65 are recorded by one unit scan operation of passes 24 to 28. For the color mode sub-scan, monochromatic mode sub-scan, and positioning alignment feed, the feed amount is larger than that of the fine feed performed within the unit scan operation (see FIGS. 4 and 5), so the feed error is also larger. The more times these sub-scans are performed for printing a certain area, the more possibility of decreasing the quality of the printing results exists. With the first working example, it is possible to reduce the number of these feeds, so it is possible to increase the quality of the printing results of the area near the boundary with the color area of the monochromatic area for which the upper edge contacts the color area.

Figure 12:
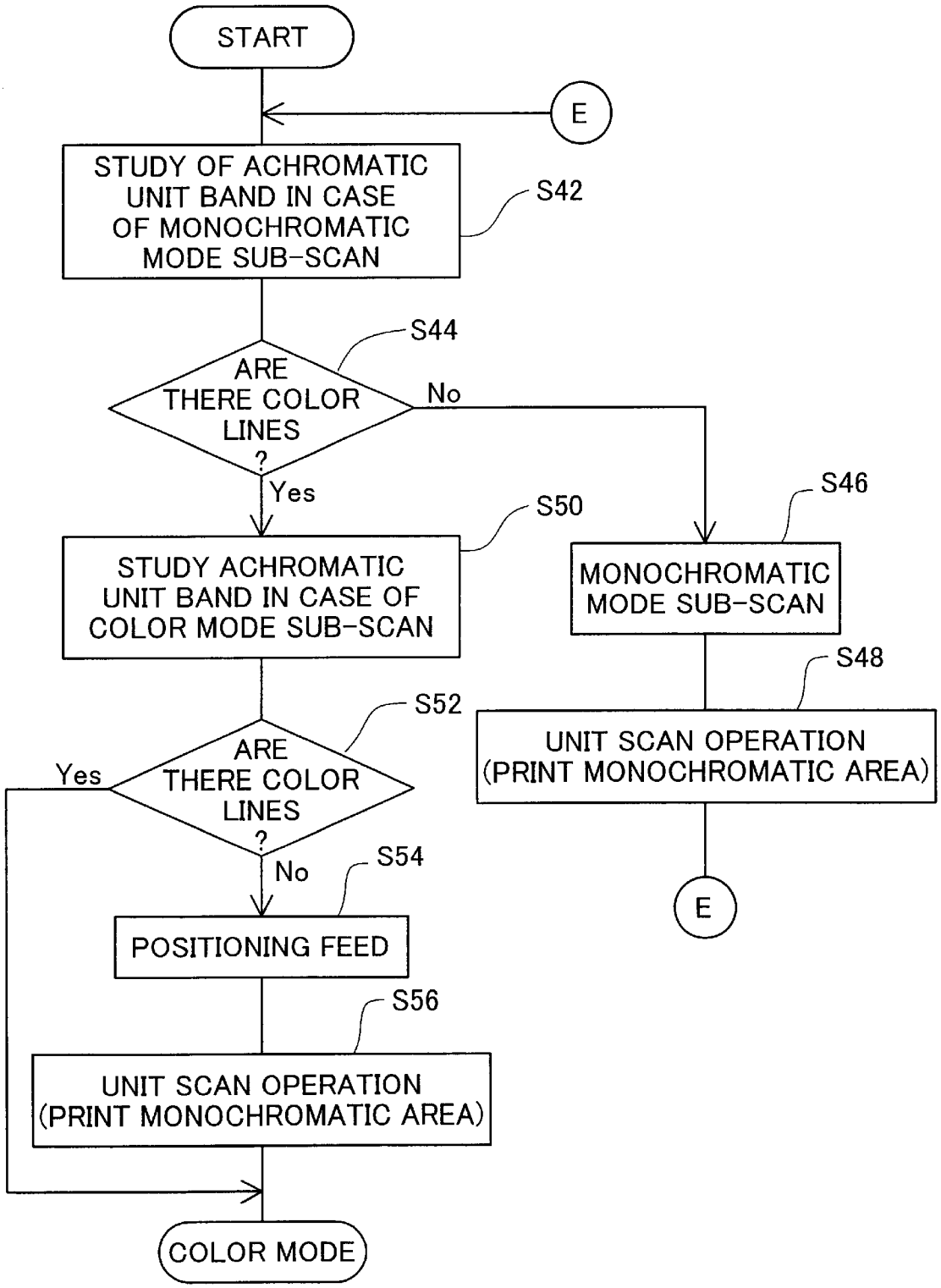
FIG. 12 is a flow chart that shows the processing of monochromatic mode printing.

(4) Shift 1 From Monochromatic Mode Printing to Color Mode Printing:

FIG. 12 is a flow chart that shows the processing for monochromatic mode printing. In monochromatic mode printing, at step S42, the problem is studied what kind of main scan lines are contained in the achromatic unit band when it is assumed that a monochromatic mode sub-scan is performed next. As a result, when it is determined that there are no color lines at step S44, a monochromatic mode sub-scan is performed at step S46, and a unit scan operation is performed using all the nozzles of black nozzle group K at step S48. After that, the process returns to step S42. In FIG. 7, printing up to pass 36 after the sub-scan performed after pass 24 is executed according to this routine.

Specifically, in monochromatic mode printing, as long as no main scan lines of color area are contained in the achromatic unit band when the monochromatic mode sub-scan is performed next, steps S46 and S48 are repeated, and monochromatic mode printing is executed.

In monochromatic mode printing, when color line is contained in the unit line or unit band recorded by executing the sub-scan studied as the next item to be performed and the unit scan operation executed thereafter, it is considered that the main scan line of the lower edge of the studied unit line or unit band is positioned in a color area. Then, when color line is not contained in that kind of unit line or unit band, the main scan line of the lower edge of the unit line or unit band is considered to be positioned in a monochromatic area.

When it is determined that there are color lines at step S44, at step S50, a study is made of what kind of main scan lines are contained in the achromatic unit band when it is assumed that a color mode sub-scan is performed next.

At step S52, when it is judged that there are no color lines, at step S54, a positioning feed is performed so that the main scan line of the lower edge of the achromatic unit band is in a relative position that matches the main scan line of the lower edge of the monochromatic area. Then, at step S56, a unit scan operation is performed using all the nozzles of black nozzle group K. However, at step S56, the width (main scan line count) of the area for which black dots are to be recorded is narrower than main scan line count L1 of the achromatic unit band, so part of the nozzles of black nozzle group K are not used for part or all of the main scan. In FIG. 7, the sub-scan performed after pass 36 and the unit scan operation of passes 37 to 40 are executed according to this routine. Here, feed amount Am1 of the positioning feed is 20 dots. After that, the process shifts to color mode printing. After shifting to color mode printing, first, a color mode sub-scan is performed. The sub-scan that is performed after pass 40 is the first sub-scan after shifting to color mode printing.

Specifically, in monochromatic mode printing, (A) when the main scan line of the lower edge of the achromatic unit band, when it is assumed that a monochromatic mode sub-scan is performed next, is positioned in a color area, and (B) when in addition the main scan line of the lower edge of the achromatic unit band, when it is assumed that a color mode sub-scan will be performed instead of a monochromatic mode sub-scan, is positioned in a monochromatic area, the following processes are performed. (1) a designated positioning feed is performed, (2) a unit scan operation is performed while dots are formed on the main scan line of a monochromatic area, after which (3) the process shifts from monochromatic mode printing to color mode printing. The positioning feed is performed so that the relative position of the printing head and printing paper is a relative position such that the main scan line of the lower edge of the achromatic unit band, when it is assumed that a unit scan operation after the sub-scan is performed once, matches the main scan line of the lower edge of the monochromatic area. This kind of shift from monochromatic mode printing to color mode printing is executed by first shift unit 41*b*1 (see FIG. 2) of monochromatic mode unit 41*b*.

With the first working example, in a case such as that noted above, a positioning feed is performed, and then a unit scan operation is performed using all the nozzles of the black nozzle group K. Then, the feed amount Sm1 of the positioning feed is bigger than feed amount Sc of the color mode sub-scan. Because of this, by performing a positioning feed, it is possible to print more efficiently than when shifting directly to color mode printing and recording the main scan lines of the remaining monochromatic areas with the special black nozzle group K0.

Figure 13:
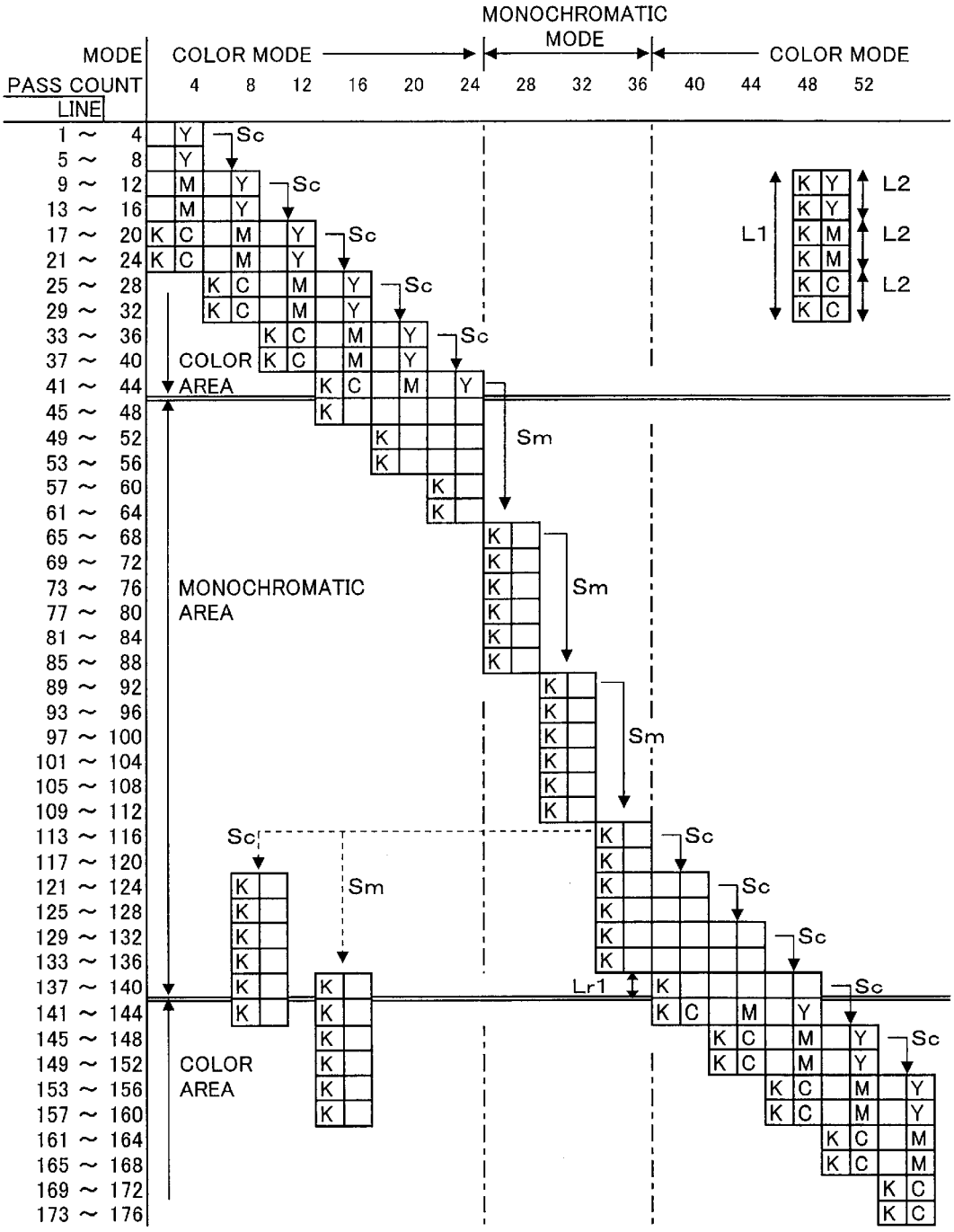
FIG. 13 is an explanatory diagram of another example that shows how image data that contains color areas and monochromatic areas is recorded.

FIG. 13 is an explanatory diagram of another example that shows how image data that contains color areas and monochromatic areas is recorded. The printing data shown in FIG. 13 is the same as that of FIG. 7 except for the fact that from above line 140 is a monochromatic area and from below line 141 is a color area. Because of this, the processing of each pass is also the same as in FIG. 7 up to pass 36. In the example shown in FIG. 13, as shown at the lower left of the figure, after pass 36, even if a color mode sub-scan is performed, the lower edge of the achromatic unit band is positioned in the color area. Thus, at step S52 in FIG. 12, it is judged that there are color lines. In this case, a shift to color mode printing is made without positioning feeds. After shifting to color mode printing, the first action performed is a color mode sub-scan. In FIG. 13, the sub-scan performed after pass 36 is the first sub-scan after shifting to color mode printing according to this routine, and the unit scan operation that includes passes 37 to 40 is the first unit scan operation for color mode printing.

Specifically, in monochromatic mode printing, when the main scan line of the lower edge of the achromatic unit band is in a monochromatic area, even when it is assumed that a color mode sub-scan is performed next, the process shifts directly to color mode printing. This kind of shift from monochromatic mode printing to color mode printing is executed by second shift unit 41*b*2 (see FIG. 2) of monochromatic mode unit 41*b*.

With the first working example, to perform processing like that shown in the lower part of FIG. 13, when shifting from monochromatic mode printing to color mode printing, it is possible to efficiently shift to color mode printing without performing extra positioning feed.

Figure 14:
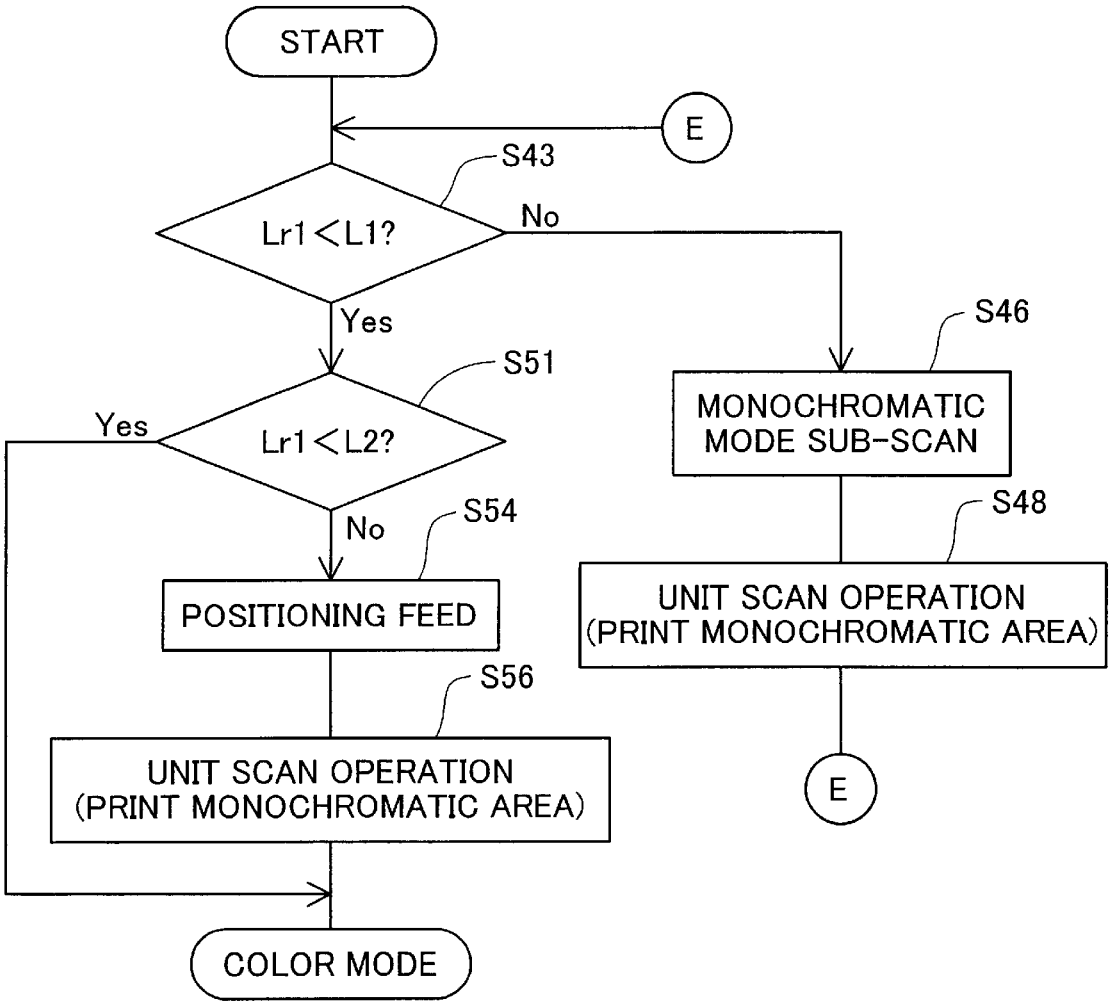
FIG. 14 is a flow chart that shows another example of processing of monochromatic mode printing.

(5) Shift 2 From Monochromatic Mode Printing to Color Mode Printing:

FIG. 14 is a flow chart that shows an example of other processing of monochromatic mode printing. In the flow chart shown in FIG. 14, step S43 is executed in place of steps S42 and S44 of FIG. 12, and step S51 is executed in place of steps S50 and S52 of FIG. 12. In other regards, the process is the same as the flow chart shown in FIG. 12. It is also possible to have the processing for monochromatic mode printing be as follows.

First, at step S43, the count Lr1 of the main scan lines of the remaining monochromatic area is compared with the count L1 of the main scan lines of the achromatic unit band. The remaining monochromatic area consists of the main scan lines of the currently recording monochromatic areas and also the main scan lines for which recording is not completed. When the count Lr1 of the main scan lines of the remaining monochromatic areas is greater than count L1 of the main scan lines of the achromatic unit band, steps S46 and S48 are executed, and monochromatic mode printing is executed.

At step S43, when it is deemed that count Lr1 of the main scan lines of the remaining monochromatic areas is less than count L1 of the main scan lines of the achromatic unit band, at step S51, count Lr1 of the main scan lines of the remaining monochromatic areas is compared with count L2 of the main scan lines of the single chromatic unit band. When it is deemed that count Lr1 of the main scan lines of the remaining monochromatic areas is greater than count L2 of the main scan lines of the single chromatic unit band, positioning feed is performed at step S54. When it is deemed that count Lr1 of the main scan lines of the remaining monochromatic areas is less than count L2 of the main scan lines of the single chromatic unit band, the process shifts to the color mode without positioning feed.

Even when this kind of processing is performed, printing such as that shown in FIGS. 7 and 13 is performed as appropriate. If this kind of processing is used, it is possible to shift from monochromatic mode printing to color mode printing with simpler processing. For comparison purposes, count L1 of the main scan lines of the achromatic unit band and count L2 of the main scan lines of the single chromatic unit band of each single chromatic nozzle group are shown in the upper right of FIGS. 7 and 13.

B. SECOND WORKING EXAMPLE (1) Color Mode Printing and Monochromatic Mode Printing:

FIGS. 15 and 16 are explanatory diagrams that show the printer nozzle arrangement and the recording of main scan lines by the unit scan operation for a second working example. For the printer of the second working example as well, the nozzles provided on the printing head are arranged at a pitch k of 4 in the sub-scan direction. However, for the printer of the second working example, black nozzle group K has 15 nozzles aligned in a row in the sub-scan direction. The single chromatic nozzle groups C, M, and Y each have 5 nozzles aligned in a row in the sub-scan direction. Then, of the black nozzle group K, special black nozzle group K0 used for color mode printing consists of nozzles #11 to #15. In other regards, this printer is the same as the printer for the first working example. For the second working example, as shown in FIGS. 15 and 16, one unit scan operation is completed by three repetitions of a 3-dot feed and by performing four main scans. In this way, by using the 3 dot feed amount which is disjoint with a nozzle pitch of 4 dots, it is possible to record the main scan lines without gaps by repeating the unit scan operation. This 3-dot feed amount that is performed within a unit scan operation is the "first feed amount" mentioned in the claims.

With the second working example, to perform a 3-dot feed, the main scan lines recorded by a unit scan operation are not all adjacently in contact with each other. To explain the example shown in FIG. 15, line 1, lines 4 and 5, and line 7 are recorded with one unit scan operation, but lines 2 and 3 between line 1 and line 4 are not recorded by that unit scan operation. Line 6 which is between line 5 and line 7 is also not recorded by that unit scan operation. Because of this, with the second working example, the achromatic unit lines are the 60 main scan lines from lines 1 to 66 in FIG. 15, but the achromatic unit band is the 54 main scan lines among these from lines 7 to 60. Thus, the count L1 of the main scan lines of the achromatic unit band recorded by black nozzle group K is 54 lines. Then, the main scan lines that are recorded by the same unit scan operation as that achromatic unit band exist between the top side and bottom side of the achromatic unit band, sandwiching the main scan lines not recorded by that unit scan operation. These main scan lines are also included in the achromatic unit lines.

In FIG. 15, at pass 4 which is the final pass of the unit scan operation, nozzle #1 is positioned at line 10. In monochromatic mode printing, with pass 5 which is the first pass of the next unit scan operation, nozzle #1 comes to the position of line 61 which was not recorded by the previous unit scan operation. Specifically, feed amount Sm of the monochromatic mode sub-scan is 51 dots. This monochromatic mode sub-scan is performed such that the nozzle of the top edge of black nozzle group K is positioned at the main scan line (line 61) one below the lower edge main scan line (line 60 in FIG. 15) of the bundle of main scan lines that are aligned without a gap in the sub-scan direction and that are the bundle of main scan lines recorded by the immediately preceding unit scan operation. By performing this kind of monochromatic mode sub-scan, each main scan line is recorded without a gap with monochromatic mode printing.

In this way, if the feed amount of the sub-scan performed for the unit scan operation is 2 dots or greater, a portion of the main scan lines recorded by each unit scan operation are positioned alternating with each other. For example, with the example shown in FIG. 15, lines 62, 63, and 66 are recorded with the first unit scan operation, while lines 60, 61, 64, and 65 sandwiched between these are recorded with the next unit scan operation. Because of this, the boundary line between achromatic unit bands recorded by the unit scan operations is not very visible, and the quality of the printing results is higher. This is also the same for the case of the color mode printing shown in FIG. 16. The same is also true for the boundary line of the achromatic unit band and the color unit band.

We can think in the same way about the other single chromatic nozzle groups C, M, and Y and the special black nozzle group K0 used for color mode printing. Specifically, to explain the example of the yellow nozzle group in FIG. 16, the main scan lines recorded by nozzles #1 to #5 of the yellow nozzle group with one unit scan operation are 20 main scan lines from line 1 to line 26, but the main scan lines that are recorded without a gap in the sub-scan direction are the 14 main scan lines of these from line 7 to line 20. Specifically, the count L2 of the main scan lines of the single chromatic unit band of the single chromatic nozzle groups Y, M, and C is 14 lines for each. The same thought as for cyan nozzle group C can be applied for the special black nozzle group K0. Then, the main scan line count for the color unit band is also 14 lines. In comparison to this, the main scan line count for the color unit lines is 20 lines.

To explain using FIG. 16 for reference, with the color mode sub-scan performed after pass 4, yellow nozzle #1 is sent from the line 10 position to the line 21 position. Specifically, feed amount Sc of the color mode sub-scan is 11 dots. The color mode sub-scan is performed such that the nozzle positioned at the top of the nozzles of the plurality of single chromatic nozzle group (nozzle #1 of the yellow nozzle group) is positioned at the main scan line (line 21) one below the lower edge main scan line (line 20 of FIG. 16) of the bundle of main scan lines aligned without a gap in the sub-scan direction which is the bundle of main scan lines for which recording is completed with the immediately prior unit scan operation. By performing this kind of color mode sub-scan, the main scan lines are recorded without a gap with color mode printing.

Figure 17:
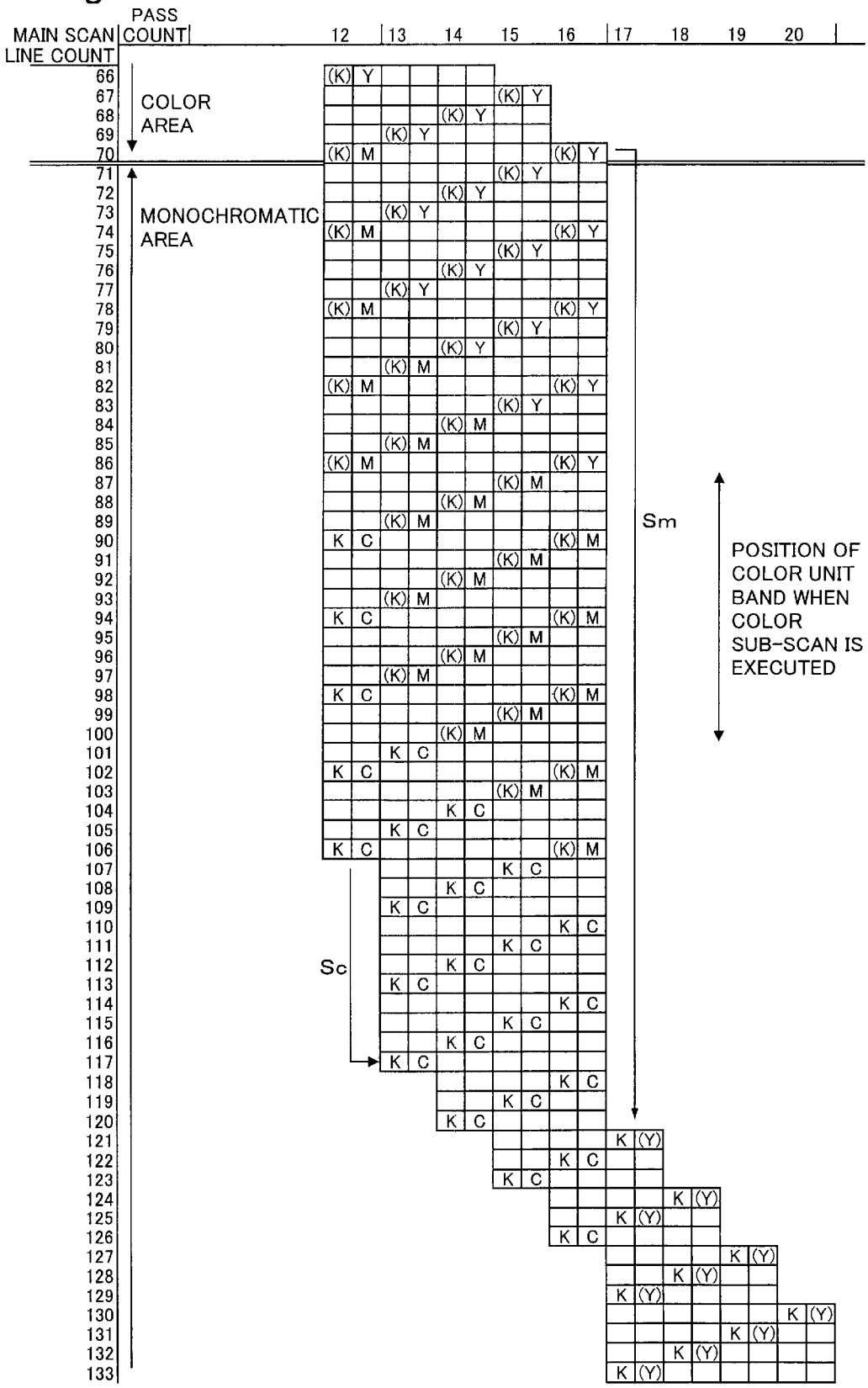
FIG. 17 is an explanatory diagram that shows how image data that contains color areas and monochromatic areas is recorded for a second working example.

(2) Shift From Color Mode Printing to Monochromatic Mode Printing:

FIG. 17 is an explanatory diagram that shows how image data that contains color areas and monochromatic areas is recorded for the second working example. Here, when a unit scan operation such as that shown in FIGS. 15 and 16 is performed, we will explain how printing is performed according to the flow chart of FIG. 6. In the figure below FIG. 17, each pass number is noted without omission, so to make it easier to understand, we have put a delineation line at the pass count space for each unit pass. For the example shown in FIG. 17, from above line 70 of the image data is a color area, and from below line 71 is a monochromatic area. Therefore, color mode printing is executed first.

The nozzles do not reach above the monochromatic area at first. Then, though not shown in FIG. 17, part of the nozzles of special black nozzle group K0 reach above the monochromatic area from pass 5. At this time, the main scan lines of the monochromatic area are recorded by nozzles #11 to #15 of the special black nozzle group K0. For passes 12 to 17 shown in FIG. 17 as well, in the same way, the main scan lines of the monochromatic area are recorded by nozzles #11 to #15 of special black nozzle group K0.

In the state after pass 16 has ended, when a color mode sub-scan is performed next, only the main scan lines of the monochromatic area are contained in the color unit band. Specifically, in the flow chart shown in FIG. 6, at step S24, it is judged that there are no color lines. Because of this, after pass 17, the process shifts to monochromatic mode printing, a monochromatic mode sub-scan for which the feed amount Sm is 51 dots is performed, and with passes 17 to 20, a unit scan operation is performed using all nozzles of the black nozzle group.

Figure 18:
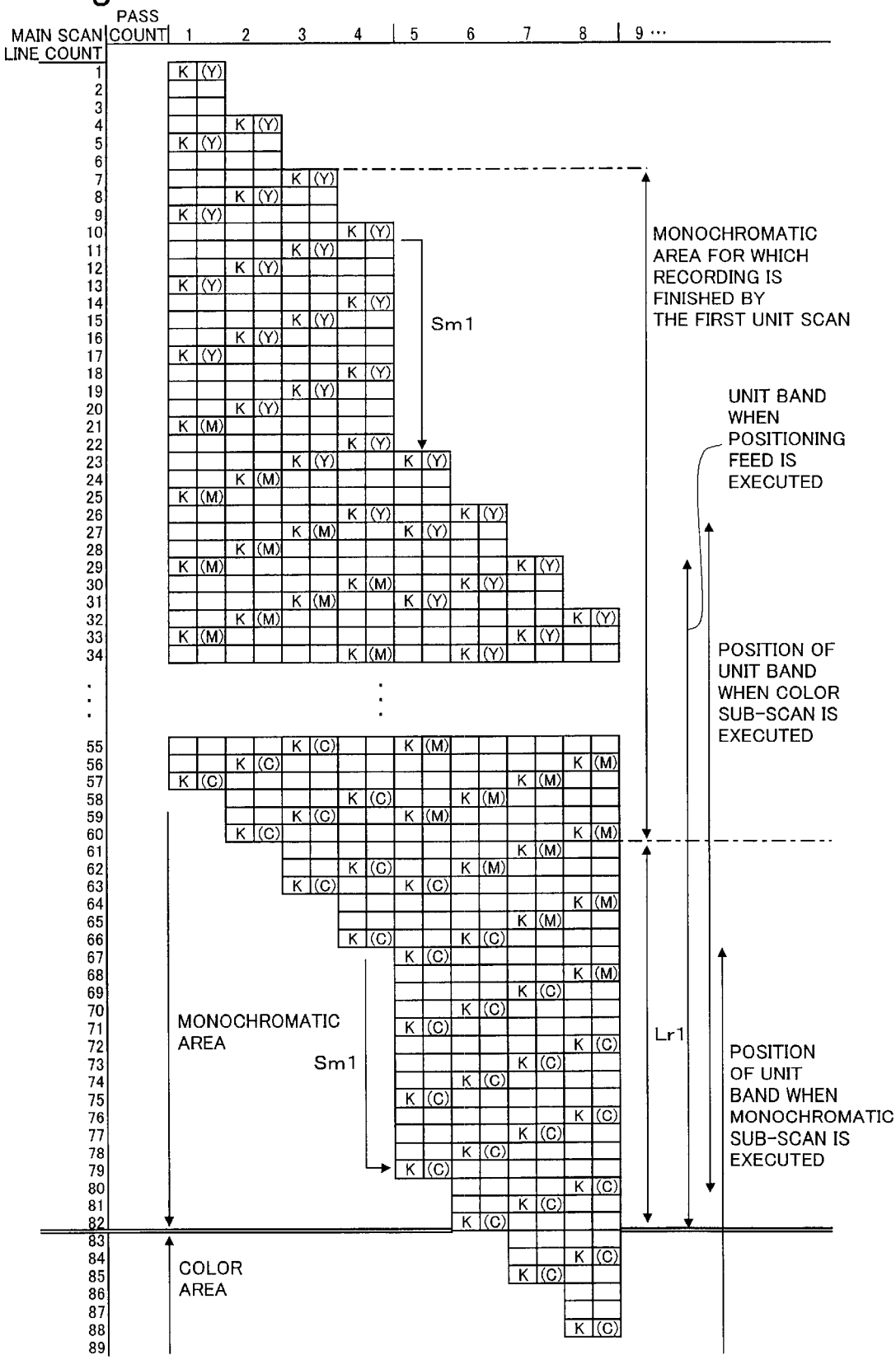
FIG. 18 is an explanatory diagram that shows how image data that contains color areas and monochromatic areas is recorded for a second working example.
Figure 19:
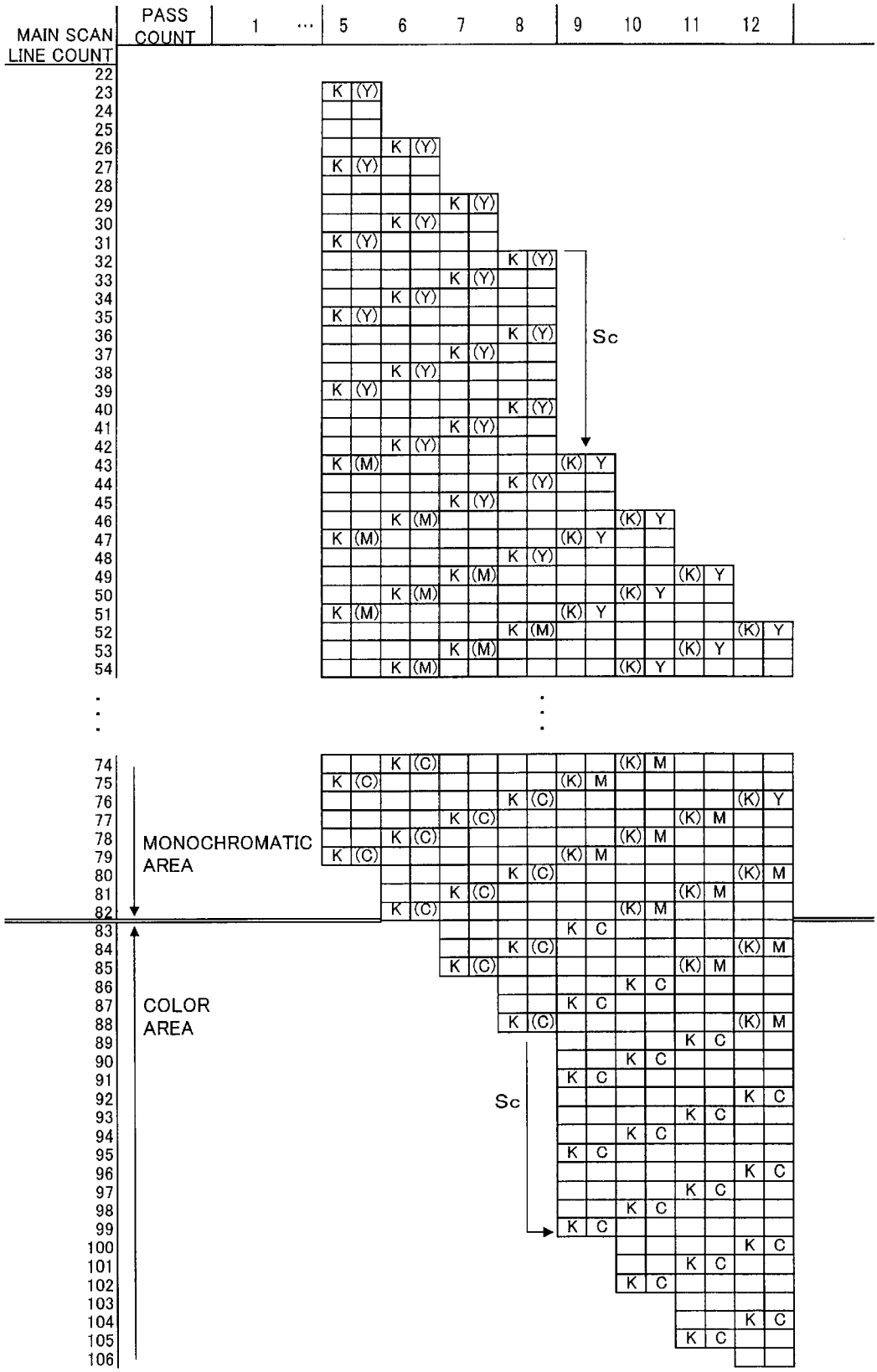
FIG. 19 is an explanatory diagram that shows how image data that contains color areas and monochromatic areas is recorded for a second working example.

(3) Shift From Monochromatic Mode Printing to Color Mode Printing:

FIGS. 18 and 19 are explanatory diagrams that show how image data that contains color areas and monochromatic areas is recorded for the second working example. Here, when a unit scan operation such as that sown in FIGS. 15 and 16 is performed, we will explain how printing is performed according to the flow chart shown in FIG. 12. In FIGS. 18 and 19, passes 5 to 8 are noted overlapping. In the example shown in FIGS. 18 and 19, from above line 82 of the image data is a monochromatic area, and from below line 83 is a color area. Therefore, monochromatic mode printing is executed first.

In the state after pass 4 has ended, when a monochromatic mode sub-scan is performed next, as shown at the right side of FIG. 18, the lower edge of the achromatic unit band is positioned in a color area. However, when a color mode sub-scan is performed next, similarly, as shown at the right side of FIG. 18, the lower edge of the achromatic unit band is positioned in a monochromatic area. Specifically, in this state, for the flow chart shown in FIG. 12, at step S44, it is judged that there are color lines, and at step S52, it is judged that there are no color lines. Because of this, positioning feed with a feed amount Am1 of 13 dots is performed after pass 4 (step S54), and at passes 5 to 8, a unit scan operation using part of the nozzles of the black nozzle group is performed (step S56).

As shown in FIG. 18, with passes 1 to 4, lines 7 to 60 are recorded continuously in the sub-scan direction. Then, the area for which recording is not completed is the area of lines 61 to 82. Lines 62, 63, and 66 for which dots are already recorded are contained in the area of lines 61 to 82. The range of the achromatic unit band, when a positioning feed is done, is lines 29 to 82 as shown at the right side of FIG. 18, so the remaining monochromatic areas are all recorded by the unit scan operation after the positioning feed is done.

After pass 8 is done, as shown in FIG. 19, the process shifts to color mode printing. Specifically, a color mode sub-scan with feed amount Sc of 11 dots is performed after pass 8, and after pass 9, all the single chromatic nozzle groups and the special black nozzle group are used.

Figure 20:
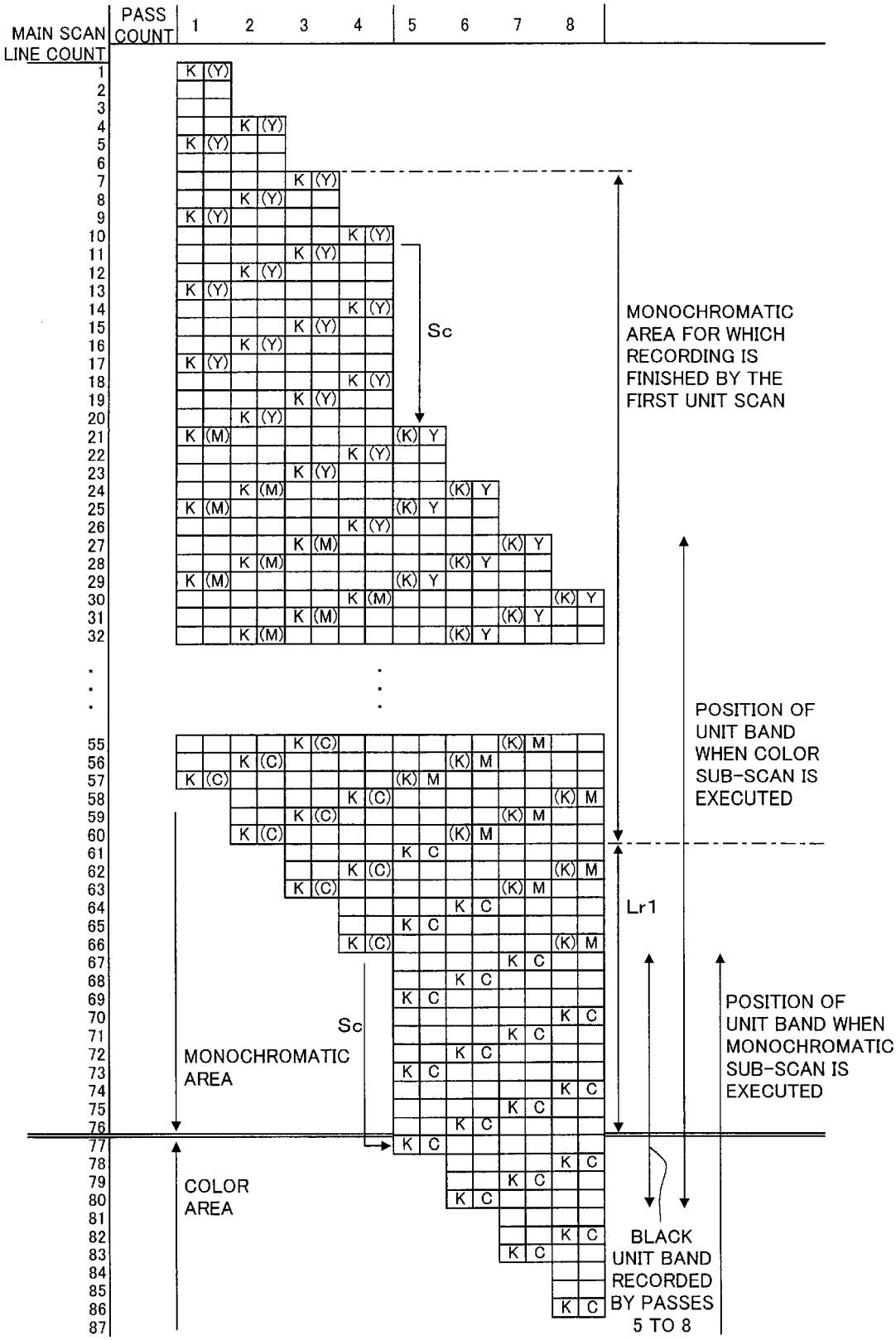
FIG. 20 is an explanatory diagram that shows how image data that contains color areas and monochromatic areas is recorded for a second working example.

FIG. 20 is an explanatory diagram that shows how image data that contains color areas and monochromatic areas are recorded for the second working example. In the example shown in FIG. 20, from line 76 of the image data and above is a monochromatic area, and from line 77 and below is a color area.

In the state after pass 4 has ended, the lower edge of the achromatic unit band is positioned in the color area, even when a monochromatic mode sub-scan or a color mode sub-scan is performed next, as shown at the right side of FIG. 20. Specifically, in this state, in the flow chart shown in FIG. 12, at step S44, it is judged that there are color lines, and at step S52, it is also judged that there are color lines. Because of this, after pass 4, the process shifts to color mode printing without positioning feed. Specifically, after pass 4, a color mode sub-scan with a feed amount Sc of 11 dots is performed, and after pass 5, each of the single chromatic nozzle groups C, M, and Y as well as special black nozzle group K0 (nozzles #1 to #15) are used.

The unit band that is recorded by special black nozzle group K0 at passes 5 to 8 is lines 67 to 80. Thus, lines 61 to 76 (the remaining monochromatic area) for which recording was not completed by pass 4 is recorded by special black nozzle group K0 at passes 5 to 8.

With the example shown in FIGS. 18 and 19 as well as FIG. 20, a judgment was made of whether the process shifted from monochromatic mode printing to color mode printing according to the flow chart shown in FIG. 12, but it is also possible to make a judgment according to the flow chart shown in FIG. 14. Specifically, it is possible to make a comparison of count Lr1 of the main scan lines of the remaining monochromatic areas with count L1 of the main scan lines of the achromatic unit band and with count L2 of the main scan lines of the single chromatic unit band to judge whether a shift to color mode printing is made.

C. Variation Example

Note that this invention is not limited by the working examples and embodiments noted above, but that in fact it is possible to implement the invention in a variety of aspects that do not stray from the scope of the key points, with a variation such as follows possible.

FIGS. 21 and 22 are explanatory diagrams that show another unit scan operation. The color mode printing and monochromatic mode printing shown above can be applied to nozzle configurations and unit scan operations other than the nozzle configurations and unit scan operations shown in FIGS. 4 and 5 as well as in FIGS. 15 and 16. For example, as shown in FIGS. 21 and 22, for the same nozzle configuration as the nozzle configuration shown in FIGS. 15 and 16, it is also possible to apply this to a case of doing three repetitions of a small feed of 1 dot each and performing four main scans to complete a unit scan operation. For this kind of embodiment, as shown in FIG. 21, the achromatic unit band recorded with one unit scan operation is 60 continuous main scan lines, and as shown in FIG. 22, the single chromatic unit band is 20 continuous main scan lines. For this kind of embodiment, the main scan lines recorded by the unit scan operation are all aligned with no gap in the sub-scan direction, so it is possible to execute printing with the same processing as for the first working example.

Nozzle pitch k can also be set to a suitable value such as 6 or 8 rather than being limited to the value 4. In this case, it is preferable that the feed amount of the fine feed performed with the unit scan operation be a value that is disjoint with nozzle pitch k. By setting in this way, it is possible to perform sub-scans with a constant feed amount and to record all the main scan lines with no gap. It is also preferable that the fine feed count be (k−1).

Figure 23:
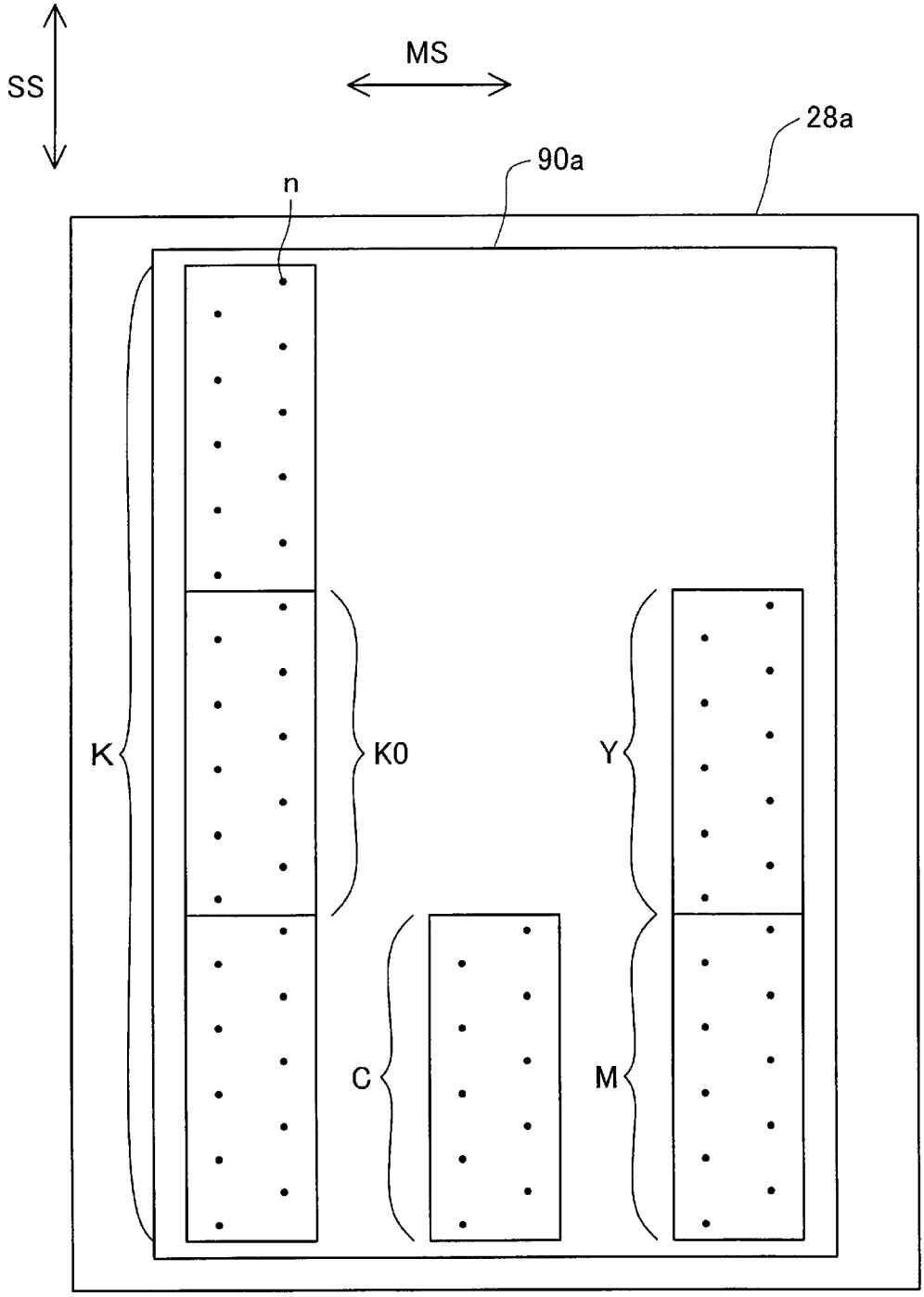
FIG. 23 is an explanatory diagram that shows the nozzle arrangement for printing head 28*a* of another embodiment.
Figure 24:
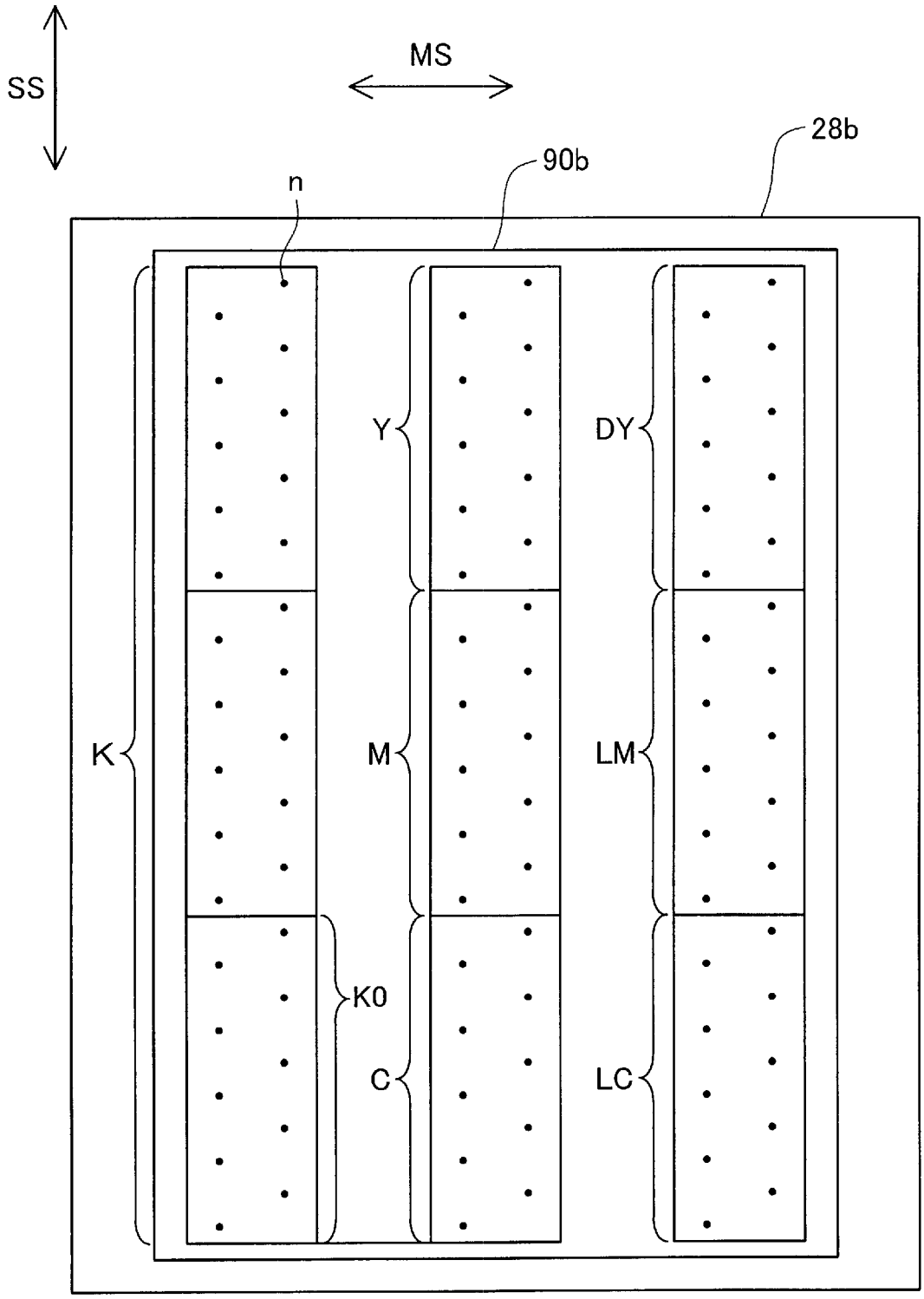
FIG. 24 is an explanatory diagram that shows the nozzle arrangement for printing head 28*b* of another embodiment.

FIGS. 23 and 24 are explanatory diagrams that show the nozzle arrangement of printing heads 28*a* and 28*b* of another embodiment. In the aforementioned working examples, the nozzles contained in each nozzle group were aligned in a row, but the nozzles contained in each nozzle group can also be aligned in two rows as shown in FIG. 23 or in 3 or more rows. Also, the nozzles of a nozzle group can also be arranged in an array whereby they have different arrangements from each other in sub-scan direction SS, a so-called zigzag arrangement. Then, for the aforementioned working examples, each nozzle row for cyan, magenta, and yellow was aligned in a row in the sub-scan direction SS, but it is also possible to provide the single chromatic nozzle groups provided in differing positions for main scan direction MS as shown in FIG. 23. It is also acceptable if the range in which the achromatic nozzle groups exist in the sub-scan direction SS and the range in which a plurality of single chromatic nozzle groups exist in the sub-scan direction SS do not match. Furthermore, for the aforementioned working examples, the single chromatic nozzle groups were the cyan, magenta, and yellow nozzle groups, but single chromatic nozzle groups can also include nozzle groups that eject other color inks such as light cyan, light magenta, and dark yellow as shown in FIG. 24, for example. It is also possible to include nozzles that eject achromatic inks such as gray. Specifically, the "single chromatic nozzle groups" can have any nozzle arrangement, any ink color, and any number of ink colors as long as there is a mutually equal number of nozzles and these eject different colored inks from each other. The inks ejected by single chromatic nozzle groups are the inks used for color mode printing.

Also, with the aforementioned working examples, the achromatic nozzle groups were nozzle groups that eject black ink, but when printing data includes areas to be recorded by a single color ink other than black, it is possible to eject an ink for recording that area from an achromatic nozzle group. Furthermore, it is also possible to provide two or more achromatic nozzle groups. In this case, it is preferable that the number of nozzles of each single chromatic nozzle group be equal.

Also, with the aforementioned working examples, the special black nozzle group K0 used for color mode printing was one group of nozzles placed at the bottom of the nozzles of black nozzle group K. However, as shown in FIG. 23, a special achromatic nozzle group can be nozzle group K0 that is placed near the center of sub-scan direction SS of the achromatic nozzle group, or can be nozzles placed in another position. Specifically, it can be a nozzle group that is part of the achromatic nozzle group and that contains the same number of nozzles as the single chromatic nozzle groups.

The printing head may include a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks. The printing head may also include an achromatic nozzle group for ejecting achromatic ink. The achromatic nozzle group consists of a greater number of nozzles that are arranged at nozzle pitch k×D than each of the single chromatic nozzle groups.

The color mode printing may be executed by repeating a unit scan operation using a specific achromatic nozzle group and the plurality of single chromatic nozzle groups. The unit scan operation consists of k main scans and (k−1) sub-scans of a first feed amount. The color mode sub-scan of a second feed amount may be performed in each interval between each unit scan operations.

The monochromatic mode printing may be executed by repeating the unit scan operation using all the nozzles of the achromatic nozzle group but without using the single chromatic nozzle groups while a monochromatic mode sub-scan of a third feed amount more than the second feed amount is performed in each interval between each unit scan operations.

With each of the aforementioned working examples, we gave an explanation of an inkjet printer, but the present invention is not limited to inkjet printers, but rather can generally be applied to various printing apparatus that perform printing using printing heads. Also, the present invention is not limited to a method and device for ejecting ink drops, but can also be applied to a method or device for recording dots by other means.

With each of the aforementioned working examples, it is possible to replace part of the configuration that is realized by hardware using software, and conversely, part of the configuration that is realized using software can be replaced by hardware. For example, part of the function of head drive circuit 52 shown in FIG. 2 can be realized using software.

Although the present invention has been described and illustrated in detail, it is clearly understood that the same is by way of illustration and example only and is not to be taken by way of limitation, the spirit and scope of the present invention being limited only by the terms of the appended claims.

I claim:

1. A printing method comprising the steps of:

providing a print head having a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch k×D than each of the single chromatic nozzle groups; and printing images in a monochromatic area on a printing medium with the achromatic ink alone, and in a color area with the chromatic inks, the step of printing images comprising the steps of:

(a) executing monochromatic mode printing by repeating a unit scan operation using all the nozzles of the achromatic nozzle group but without using the single chromatic nozzle groups, the unit scan operation consisting of k main scans and (k−1) sub-scans of a first feed amount, wherein the unit scan operation in the monochromatic mode printing is performed such that all dot positions in an achromatic unit band consisting of plural main scan lines without any gap therebetween are serviced by the achromatic nozzle group, and wherein a monochromatic mode sub-scan of a second feed amount is performed in each interval between each unit scan operations, and (b) executing color mode printing by repeating the unit scan operation using a specific achromatic nozzle group and the plurality of single chromatic nozzle groups while a color mode sub-scan of a third feed amount less than the second feed amount is performed in each interval between each unit scan operations, the specific achromatic nozzle group being part of the achromatic nozzle group, wherein the step (a) comprises:

(a1) in a case that a lowermost main scan line of the achromatic unit band comes to be positioned within the color area when it is assumed that the monochromatic mode sub-scan and the unit scan operation are performed next, and also that the lowermost main scan line of the achromatic unit band comes to be positioned within the monochromatic area when it is assumed that the color mode sub-scan and the unit scan operation are performed, performing a sub-scan of a specific feed amount so that the lowermost main scan line of the achromatic unit band comes to a lower edge of the monochromatic area when the unit scan operation is performed after the sub-scan of the specific feed amount;

performing the unit scan operation once, while forming dots in the monochromatic area using all nozzles of the achromatic nozzle group; and proceeding to the color mode printing.

2. The printing method according to claim 1, wherein each of the plurality of single chromatic nozzle groups consists of mutually equal numbers of nozzles, and the specific achromatic nozzle group includes a same number of nozzles as each of the single chromatic nozzle groups.

3. The printing method according to claim 1, wherein the step (a) further comprises:

(a2) proceeding to the color mode printing in a case that the lowermost main scan line of the achromatic unit band comes to be positioned in the color area when it is assumed that the color mode sub-scan and the unit scan operation are performed.

4. The printing method according to claim 1, wherein the plurality of single chromatic nozzle groups includes C nozzle rows, where C is an integer of at least 2, each of which includes N nozzles, where N is an integer of at least 2, arranged in the sub-scan direction at the nozzle pitch k×D, the achromatic nozzle group includes a nozzle row consisting of N×C nozzles arranged in the sub-scan direction at the nozzle pitch k×D, wherein the first feed amount is equal to D, the second feed amount is equal to N×C×k×D, and the third feed amount is equal to N×k×D.

5. The printing method according to claim 1, wherein the plurality of single chromatic nozzle groups includes C nozzle rows, where C is an integer of at least 2, each of which includes N nozzles, where N is an integer of at least 2, arranged in the sub-scan direction at the nozzle pitch k×D, the achromatic nozzle group includes a nozzle row consisting of N×C nozzles arranged in the sub-scan direction at the nozzle pitch k×D, wherein the first feed amount is equal to m×D (where m is an integer of 2 or greater that disjoints with k), the second feed amount is equal to a feed amount for which the sub-scan is performed at a relative position so that the nozzle of the upper edge of the achromatic nozzle group is positioned on the main scan line one below the lower edge of the bundle of main scan lines without any gap therebetween, these being the bundle of main scan lines recorded by the immediately prior unit scan operation, and the third feed amount is equal to a feed amount for which the sub-scan is performed at a relative position so that the nozzle positioned at the very top of the nozzles of the plurality of single chromatic nozzle groups is positioned on the main scan line one below the lower edge of the bundle of main scan lines without any gap therebetween, these being a bundle of main scan lines for which recording is completed by the immediately prior unit scan operation.

6. A printing method comprising the steps of:

providing a print head having a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch k×D than each of the single chromatic nozzle groups; and printing images in a monochromatic area on a printing medium with the achromatic ink alone, and in a color area with the chromatic inks, the step of printing images comprising the steps of:

(a) executing monochromatic mode printing by repeating a unit scan operation using all the nozzles of the achromatic nozzle group but without using the single chromatic nozzle groups, the unit scan operation consisting of k main scans and (k−1) sub-scans of a first feed amount, wherein the unit scan operation in the monochromatic mode printing is performed such that all dot positions in an achromatic unit band consisting of plural main scan lines without any gap therebetween are serviced by the achromatic nozzle group, and wherein a monochromatic mode sub-scan of a second feed amount is performed in each interval between each unit scan operations, (b) executing color mode printing by repeating the unit scan operation using a specific achromatic nozzle group and the plurality of single chromatic nozzle groups while a color mode sub-scan of a third feed amount less than the second feed amount is performed in each interval between each unit scan operations, the specific achromatic nozzle group being part of the achromatic nozzle group, wherein the step (a) comprises:

(a1) in a case that main scan line count Lr1 of a remaining monochromatic area is smaller than main scan line count L1 of an achromatic unit band and is larger than main scan line count L2 of a single chromatic unit band, the remaining monochromatic area being an area of the monochromatic area in which dot formation is not completed, the single chromatic unit band consisting of plural main scan lines without any gap therebetween for which a one of the single chromatic nozzle groups services with a single unit scan operation, performing a sub-scan of a specific feed amount so that the lowermost main scan line of the achromatic unit band comes to a lower edge of the monochromatic area when the unit scan operation is performed after the sub-scan of the specific feed amount;

performing the unit scan operation once, while forming dots in the monochromatic area using all nozzles of the achromatic nozzle group; and proceeding to the color mode printing.

7. The printing method according to claim 6, wherein each of the plurality of single chromatic nozzle groups consists of mutually equal numbers of nozzles, and the specific achromatic nozzle group includes a same number of nozzles as each of the single chromatic nozzle groups.

8. The printing method according to claim 6, wherein step (a) further comprises:

(a2) proceeding to the color mode printing in a case that main scan line count Lr1 of the remaining monochromatic area is smaller than the main scan line count L1 of the achromatic unit band and the main scan line count L2 of the single chromatic unit band.

9. A printing method comprising the steps of:

providing a print head having a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch k×D than each of the single chromatic nozzle groups; and printing images in a monochromatic area on a printing medium with the achromatic ink alone, and in a color area with the chromatic inks, the step of printing images comprising the steps of:

(a) executing color mode printing by repeating a unit scan operation using a specific achromatic nozzle group and the plurality of single chromatic nozzle groups, the unit scan operation consisting of k main scans and (k−1) sub-scans of a first feed amount, the specific achromatic nozzle group being part of the achromatic nozzle group, wherein a color mode sub-scan of a second feed amount is performed in each interval between each unit scan operations, (b) executing monochromatic mode printing by repeating the unit scan operation using all the nozzles of the achromatic nozzle group but without using the single chromatic nozzle groups while a monochromatic mode sub-scan of a third feed amount more than the second feed amount is performed in each interval between each unit scan operations, wherein the step (a) comprises:

(a1) in a case that all main scan lines of a color unit band come to be positioned within the monochromatic area when it is assumed that the color mode sub-scan and the unit scan operation are performed next, the color unit band consisting of plural main scan lines without any gap therebetween for which an uppermost single nozzle group services with a single unit scan operation, proceeding to the monochromatic mode printing.

10. The printing method according to claim 9, wherein each of the plurality of single chromatic nozzle groups consists of mutually equal numbers of nozzles, and the specific achromatic nozzle group includes a same number of nozzles as each of the single chromatic nozzle groups.

11. The printing method according to claim 9, wherein the plurality of single chromatic nozzle groups includes C nozzle rows, where C is an integer of at least 2, each of which includes N nozzles, where N is an integer of at least 2, arranged in the sub-scan direction at the nozzle pitch k×D, the achromatic nozzle group includes a nozzle row consisting of N×C nozzles arranged in the sub-scan direction at the nozzle pitch k×D, wherein the first feed amount is equal to D, the second feed amount is equal to N×k×D, and the third feed amount is equal to N×C×k×D.

12. The printing method according to claim 9, wherein the plurality of single chromatic nozzle groups includes C nozzle rows, where C is an integer of at least 2, each of which includes N nozzles, where N is an integer of at least 2, arranged in the sub-scan direction at the nozzle pitch k×D, the achromatic nozzle group includes a nozzle row consisting of N×C nozzles arranged in the sub-scan direction at the nozzle pitch k×D, wherein the first feed amount is equal to m×D (where m is an integer of 2 or greater that disjoints with k), the second feed amount is equal to a feed amount for which the sub-scan is performed at a relative position so that the nozzle positioned at the very top of the nozzles of the plurality of single chromatic nozzle groups is positioned on the main scan line one below the lower edge of the bundle of main scan lines without any gap therebetween, these being a bundle of main scan lines for which recording is completed by the immediately prior unit scan operation, and the third feed amount is equal to a feed amount for which the sub-scan is performed at a relative position so that the nozzle of the upper edge of the achromatic nozzle group is positioned on the main scan line one below the lower edge of the bundle of main scan lines without any gap therebetween, these being the bundle of main scan lines recorded by the immediately prior unit scan operation.

13. A printing apparatus which prints images in a monochromatic area on a printing medium with an achromatic ink alone, and in a color area with chromatic inks, by ejecting ink drops from a nozzle to deposit the ink drops on the printing medium to form dots, comprising:

a printing head having:

a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks; and an achromatic nozzle group for ejecting achromatic ink, the achromatic nozzle group consisting of a greater number of nozzles that are arranged at nozzle pitch k×D than each of the single chromatic nozzle groups; and a main scan drive unit that moves at least one of the printing head and the printing medium to perform main scanning, a sub-scan drive unit that moves at least one of the printing head and the printing medium in a direction that intersects a main scanning direction to perform sub-scanning, and a control unit that controls each of these units, wherein the control unit has:

(a) a monochromatic mode unit that executes monochromatic mode printing by repeating a unit scan operation using all the nozzles of the achromatic nozzle group but without using the single chromatic nozzle groups, the unit scan operation consisting of k main scans and (k−1) sub-scans of a first feed amount, wherein the unit scan operation in the monochromatic mode printing is performed such that all dot positions in an achromatic unit band consisting of plural main scan lines without any gap therebetween are serviced by the achromatic nozzle group, and wherein a monochromatic mode sub-scan of a second feed amount is performed in each interval between each unit scan operations, (b) a color mode unit that executes color mode printing by repeating the unit scan operation using a specific achromatic nozzle group and the plurality of single chromatic nozzle groups while a color mode sub-scan of a third feed amount less than the second feed amount is performed in each interval between each unit scan operations, the specific achromatic nozzle group being part of the achromatic nozzle group, wherein the monochromatic mode unit comprising:

a first shifting unit that performs a sub-scan of a specific feed amount so that the lowermost main scan line of the achromatic unit band comes to a lower edge of the monochromatic area when the unit scan operation is performed after the sub-scan of the specific feed amount;

performs the unit scan operation once, while forming dots in the monochromatic area using all nozzles of the achromatic nozzle group; and proceeds to the color mode printing;

in a case that a lowermost main scan line of the achromatic unit band comes to be positioned within the color area when it is assumed that the monochromatic mode sub-scan and the unit scan operation are performed next, and also that the lowermost main scan line of the achromatic unit band comes to be positioned within the monochromatic area when it is assumed that the color mode sub-scan and the unit scan operation are performed.

14. The printing apparatus according to claim 13, wherein each of the plurality of single chromatic nozzle groups consists of mutually equal numbers of nozzles, and the specific achromatic nozzle group includes a same number of nozzles as each of the single chromatic nozzle groups.

15. The printing apparatus according to claim 13, wherein the monochromatic mode unit further comprises:

a second shifting unit that proceeds to the color mode printing in a case that the lowermost main scan line of the achromatic unit band comes to be positioned in the color area when it is assumed that the color mode sub-scan and the unit scan operation are performed.

16. The printing apparatus according to claim 13, wherein the plurality of single chromatic nozzle groups includes C nozzle rows, where C is an integer of at least 2, each of which includes N nozzles, where N is an integer of at least 2, arranged in the sub-scan direction at the nozzle pitch k×D, the achromatic nozzle group includes a nozzle row consisting of N×C nozzles arranged in the sub-scan direction at the nozzle pitch k×D, wherein the first feed amount is equal to D, the second feed amount is equal to N×C×k×D, and the third feed amount is equal to N×k×D.

17. The printing apparatus according to claim 13, wherein the plurality of single chromatic nozzle groups includes C nozzle rows, where C is an integer of at least 2, each of which includes N nozzles, where N is an integer of at least 2, arranged in the sub-scan direction at the nozzle pitch k×D, the achromatic nozzle group includes a nozzle row consisting of N×C nozzles arranged in the sub-scan direction at the nozzle pitch k×D, wherein the first feed amount is equal to m×D (where m is an integer of 2 or greater that disjoints with k), the second feed amount is equal to a feed amount for which the sub-scan is performed at a relative position so that the nozzle of the upper edge of the achromatic nozzle group is positioned on the main scan line one below the lower edge of the bundle of main scan lines without any gap therebetween, these being the bundle of main scan lines recorded by the immediately prior unit scan operation, and the third feed amount is equal to a feed amount for which the sub-scan is performed at a relative position so that the nozzle positioned at the very top of the nozzles of the plurality of single chromatic nozzle groups is positioned on the main scan line one below the lower edge of the bundle of main scan lines without any gap therebetween, these being a bundle of main scan lines for which recording is completed by the immediately prior unit scan operation.

18. The printing apparatus according to claim 17, wherein each of the plurality of single chromatic nozzle groups consists of mutually equal numbers of nozzles, and the specific achromatic nozzle group includes a same number of nozzles as each of the single chromatic nozzle groups.

19. A printing apparatus which prints images in a monochromatic area on a printing medium with an achromatic ink alone, and in a color area with chromatic inks, by ejecting ink drops from a nozzle to deposit the ink drops on the printing medium to form dots, comprising:

a printing head having:

a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks; and an achromatic nozzle group for ejecting achromatic ink, the achromatic nozzle group consisting of a greater number of nozzles that are arranged at nozzle pitch k×D than each of the single chromatic nozzle groups; and a main scan drive unit that moves at least one of the printing head and the printing medium to perform main scanning, a sub-scan drive unit that moves at least one of the printing head and the printing medium in a direction that intersects a main scanning direction to perform sub-scanning, and a control unit that controls each of these units, wherein the control unit has:

(a) a monochromatic mode unit that executes monochromatic mode printing by repeating a unit scan operation using all the nozzles of the achromatic nozzle group but without using the single chromatic nozzle groups, the unit scan operation consisting of k main scans and (k−1) sub-scans of a first feed amount, wherein the unit scan operation in the monochromatic mode printing is performed such that all dot positions in an achromatic unit band consisting of plural main scan lines without any gap therebetween are serviced by the achromatic nozzle group, and wherein a monochromatic mode sub-scan of a second feed amount is performed in each interval between each unit scan operations, (b) a color mode unit that executes color mode printing by repeating the unit scan operation using a specific achromatic nozzle group and the plurality of single chromatic nozzle groups while a color mode sub-scan of a third feed amount less than the second feed amount is performed in each interval between each unit scan operations, the specific achromatic nozzle group being part of the achromatic nozzle group, wherein the monochromatic mode unit comprising:

a first shifting unit that performs a sub-scan of a specific feed amount so that the lowermost main scan line of the achromatic unit band comes to a lower edge of the monochromatic area when the unit scan operation is performed after the sub-scan of the specific feed amount;

performs the unit scan operation once, while forming dots in the monochromatic area using all nozzles of the achromatic nozzle group; and proceeds to the color mode printing, in the case that main scan line count Lr1 of a remaining monochromatic area is smaller than main scan line count L1 of an achromatic unit band and is larger than main scan line count L2 of a single chromatic unit band, the remaining monochromatic area being an area of the monochromatic area in which dot formation is not completed, the single chromatic unit band consisting of plural main scan lines without any gap therebetween for which a one of the single chromatic nozzle groups services with a single unit scan operation.

20. The printing apparatus according to claim 19, wherein each of the plurality of single chromatic nozzle groups consists of mutually equal numbers of nozzles, and the specific achromatic nozzle group includes a same number of nozzles as each of the single chromatic nozzle groups.

21. The printing apparatus according to claim 19, wherein the monochromatic mode unit further comprises:

a second shifting unit that proceeds to the color mode printing in a case that main scan line count Lr1 of the remaining monochromatic area is smaller than the main scan line count L1 of the achromatic unit band and the main scan line count L2 of the single chromatic unit band.

22. A printing apparatus which prints images in a monochromatic area on a printing medium with an achromatic ink alone, and in a color area with chromatic inks, by ejecting ink drops from a nozzle to deposit the ink drops on the printing medium to form dots, comprising:

a printing head having:

a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks; and an achromatic nozzle group for ejecting achromatic ink, the achromatic nozzle group consisting of a greater number of nozzles that are arranged at nozzle pitch k×D than each of the single chromatic nozzle groups; and a main scan drive unit that moves at least one of the printing head and the printing medium to perform main scanning, a sub-scan drive unit that moves at least one of the printing head and the printing medium in a direction that intersects a main scanning direction to perform sub-scanning, and a control unit that controls each of these units, wherein the control unit has:

(a) a color mode unit that executes color mode printing by repeating a unit scan operation using a specific achromatic nozzle group and the plurality of single chromatic nozzle groups, the unit scan operation consisting of k main scans and (k−1) sub-scans of a first feed amount, the specific achromatic nozzle group being part of the achromatic nozzle group, wherein a color mode sub-scan of a second feed amount is performed in each interval between each unit scan operations, (b) a monochromatic mode unit that executes monochromatic mode printing by repeating the unit scan operation using all the nozzles of the achromatic nozzle group but without using the single chromatic nozzle groups while a monochromatic mode sub-scan of a third feed amount more than the second feed amount is performed in each interval between each unit scan operations, wherein the color mode unit comprising:

a shifting unit that proceeds to the monochromatic mode printing, in a case that all main scan lines of a color unit band come to be positioned within the monochromatic area when it is assumed that the color mode sub-scan and the unit scan operation are performed next, the color unit band consisting of plural main scan lines without any gap therebetween for which an uppermost single nozzle group services with a single unit scan operation.

23. The printing apparatus according to claim 22, wherein the plurality of single chromatic nozzle groups includes C nozzle rows, where C is an integer of at least 2, each of which includes N nozzles, where N is an integer of at least 2, arranged in the sub-scan direction at the nozzle pitch k×D, the achromatic nozzle group includes a nozzle row consisting of N×C nozzles arranged in the sub-scan direction at the nozzle pitch k×D, wherein the first feed amount is equal to D, the second feed amount is equal to N×k×D, and the third feed amount is equal to N×C×k×D.

24. The printing apparatus according to claim 22, wherein the plurality of single chromatic nozzle groups includes C nozzle rows, where C is an integer of at least 2, each of which includes N nozzles, where N is an integer of at least 2, arranged in the sub-scan direction at the nozzle pitch k×D, the achromatic nozzle group includes a nozzle row consisting of N×C nozzles arranged in the sub-scan direction at the nozzle pitch k×D, wherein the first feed amount is equal to m×D (where m is an integer of 2 or greater that disjoints with k), the second feed amount is equal to a feed amount for which the sub-scan is performed at a relative position so that the nozzle positioned at the very top of the nozzles of the plurality of single chromatic nozzle groups is positioned on the main scan line one below the lower edge of the bundle of main scan lines without any gap therebetween, these being a bundle of main scan lines for which recording is completed by the immediately prior unit scan operation, and the third feed amount is equal to a feed amount for which the sub-scan is performed at a relative position so that the nozzle of the upper edge of the achromatic nozzle group is positioned on the main scan line one below the lower edge of the bundle of main scan lines without any gap therebetween, these being the bundle of main scan lines recorded by the immediately prior unit scan operation.

25. A computer program product for printing images in a monochromatic area on a printing medium with the achromatic ink alone, and in a color area with the chromatic inks, using a computer, the computer being connected with a printing device having a printing head equipped with a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch k×D than each of the single chromatic nozzle groups, the computer program product comprising:

a computer readable medium; and a computer program stored on the computer readable medium, the computer program comprising:

(a) a monochromatic mode program for causing the computer to execute monochromatic mode printing by repeating a unit scan operation using all the nozzles of the achromatic nozzle group but without using the single chromatic nozzle groups, the unit scan operation consisting of k main scans and (k−1) sub-scans of a first feed amount, wherein the unit scan operation in the monochromatic mode printing is performed such that all dot positions in an achromatic unit band consisting of plural main scan lines without any gap therebetween are serviced by the achromatic nozzle group, and wherein a monochromatic mode sub-scan of a second feed amount is performed in each interval between each unit scan operations, and (b) a color mode program for causing the computer to execute color mode printing by repeating the unit scan operation using a specific achromatic nozzle group and the plurality of single chromatic nozzle groups while a color mode sub-scan of a third feed amount less than the second feed amount is performed in each interval between each unit scan operations, the specific achromatic nozzle group being part of the achromatic nozzle group, wherein the monochromatic mode program comprises:

a sub-program for causing the computer to perform a sub-scan of a specific feed amount so that the lowermost main scan line of the achromatic unit band comes to a lower edge of the monochromatic area when the unit scan operation is performed after the sub-scan of the specific feed amount;

to perform the unit scan operation once, while forming dots in the monochromatic area using all nozzles of the achromatic nozzle group; and to proceed to the color mode printing, in a case that a lowermost main scan line of the achromatic unit band comes to be positioned within the color area when it is assumed that the monochromatic mode sub-scan and the unit scan operation are performed next, and also that the lowermost main scan line of the achromatic unit band comes to be positioned within the monochromatic area when it is assumed that the color mode sub-scan and the unit scan operation are performed.

26. A computer program product for printing images in a monochromatic area on a printing medium with the achromatic ink alone, and in a color area with the chromatic inks, using a computer, the computer being connected with a printing device having a printing head equipped with a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch k×D than each of the single chromatic nozzle groups, the computer program product comprising:

a computer readable medium; and a computer program stored on the computer readable medium, the computer program comprising:

(a) a monochromatic mode program for causing the computer to execute monochromatic mode printing by repeating a unit scan operation using all the nozzles of the achromatic nozzle group but without using the single chromatic nozzle groups, the unit scan operation consisting of k main scans and (k−1) sub-scans of a first feed amount, wherein the unit scan operation in the monochromatic mode printing is performed such that all dot positions in an achromatic unit band consisting of plural main scan lines without any gap therebetween are serviced by the achromatic nozzle group, and wherein a monochromatic mode sub-scan of a second feed amount is performed in each interval between each unit scan operations, and (b) a color mode program for causing the computer to execute color mode printing by repeating the unit scan operation using a specific achromatic nozzle group and the plurality of single chromatic nozzle groups while a color mode sub-scan of a third feed amount less than the second feed amount is performed in each interval between each unit scan operations, the specific achromatic nozzle group being part of the achromatic nozzle group, wherein the monochromatic mode program comprises:

a sub-program for causing the computer to perform a sub-scan of a specific feed amount so that the lowermost main scan line of the achromatic unit band comes to a lower edge of the monochromatic area when the unit scan operation is performed after the sub-scan of the specific feed amount;

to perform the unit scan operation once, while forming dots in the monochromatic area using all nozzles of the achromatic nozzle group; and to proceed to the color mode printing, in a case that main scan line count Lr1 of a remaining monochromatic area is smaller than main scan line count L1 of an achromatic unit band and is larger than main scan line count L2 of a single chromatic unit band, the remaining monochromatic area being an area of the monochromatic area in which dot formation is not completed, the single chromatic unit band consisting of plural main scan lines without any gap therebetween for which a one of the single chromatic nozzle groups services with a single unit scan operation.

27. A computer program product for printing images in a monochromatic area on a printing medium with the achromatic ink alone, and in a color area with the chromatic inks, using a computer, the computer being connected with a printing device having a printing head equipped with a plurality of single chromatic nozzle groups each consisting of plurality of nozzles that are arranged at nozzle pitch k×D where k is an integer of at least 2 and D is a pitch of main scan lines, the plurality of single chromatic nozzle groups being configured to eject mutually different chromatic inks, and an achromatic nozzle group for ejecting achromatic ink, the achromatic nozzle group consisting of a greater number of nozzles that are arranged at nozzle pitch k×D than each of the single chromatic nozzle groups, the computer program product comprising:

a computer readable medium; and a computer program stored on the computer readable medium, the computer program comprising:

(a) a color mode program for causing the computer to execute color mode printing by repeating a unit scan operation using a specific achromatic nozzle group and the plurality of single chromatic nozzle groups, the unit scan operation consisting of k main scans and (k−1) sub-scans of a first feed amount, the specific achromatic nozzle group being part of the achromatic nozzle group, wherein a color mode sub-scan of a second feed amount is performed in each interval between each unit scan operations, (b) a monochromatic mode program for causing the computer to execute monochromatic mode printing by repeating the unit scan operation using all the nozzles of the achromatic nozzle group but without using the single chromatic nozzle groups while a monochromatic mode sub-scan of a third feed amount more than the second feed amount is performed in each interval between each unit scan operations, wherein the color mode program comprises:

a sub-program for causing the computer to proceed to the monochromatic mode printing, in a case that all main scan lines of a color unit band come to be positioned within the monochromatic area when it is assumed that the color mode sub-scan and the unit scan operation are performed next, the color unit band consisting of plural main scan lines without any gap therebetween for which an uppermost single nozzle group services with a single unit scan operation.

* * * * *